US007993209B2

(12) United States Patent
Kawai

(10) Patent No.: US 7,993,209 B2
(45) Date of Patent: Aug. 9, 2011

(54) GAP DETECTION DEVICES OF GOLF ADDRESS AND EXERCISE FORM DETECTION DEVICES

(75) Inventor: Shigehiro Kawai, Tajimi (JP)

(73) Assignee: Japana Co., Ltd., Nagoya (JP)

( * ) Notice: Subject to any disclaimer, the term of this patent is extended or adjusted under 35 U.S.C. 154(b) by 677 days.

(21) Appl. No.: 11/707,409

(22) Filed: Feb. 16, 2007

(65) Prior Publication Data

US 2007/0197305 A1 Aug. 23, 2007

(30) Foreign Application Priority Data

Feb. 17, 2006 (JP) ..... 2006-040864

(51) Int. Cl.
*A63B 69/36* (2006.01)

(52) U.S. Cl. ..... 473/151; 473/152; 473/155; 473/156

(58) Field of Classification Search ..... 473/151, 473/152, 220, 221, 155, 156
See application file for complete search history.

(56) References Cited

U.S. PATENT DOCUMENTS

| | | | | |
|---|---|---|---|---|
| 4,341,384 | A * | 7/1982 | Thackrey | 473/222 |
| 6,692,371 | B2 * | 2/2004 | Berish et al. | 473/244 |
| 6,837,799 | B2 * | 1/2005 | Cameron et al. | 473/221 |
| 2004/0221464 | A1 * | 11/2004 | Burney et al. | 33/508 |
| 2005/0213076 | A1 * | 9/2005 | Saegusa | 356/28 |

FOREIGN PATENT DOCUMENTS

JP 2002-159606 6/2002

* cited by examiner

*Primary Examiner* — Dmitry Suhol
*Assistant Examiner* — Brandon Gray
(74) *Attorney, Agent, or Firm* — Hiroe + Associates; Taras P. Bemko

(57) ABSTRACT

It is aimed at providing a golf address deviation detecting apparatus capable of detecting as to which of inaccuracy in loft angle, inaccuracy in lie angle, and inaccuracy in face orientation, inaccuracy, if any, occurred upon address by golf club is caused by. There is provided an apparatus comprising a light reflecting section(s) and light irradiating units, so that inaccuracies in loft angle, lie angle, and face orientation are detected and distinguished from one another, based on differences among patterns of the light-beams reflected by the light reflecting section(s).

15 Claims, 26 Drawing Sheets

(C)Exemplary reflection in case of rotation about X-axis (lie angle direction)

(b) Exemplary reflection in case of rotation about Z-axis (target direction)

(b) Exemplary result in case of loft angle inaccuracy (c) Exemplary result in case of lie angle inaccuracy (d) Exemplary result in case of target direction inaccuracy Situation for irradiating laser light from above Situation for irradiating laser light from below Situation for irradiating laser light from sideward (a)

(b)

(a)

(b)

GAP DETECTION DEVICES OF GOLF ADDRESS AND EXERCISE FORM DETECTION DEVICES

BACKGROUND OF THE INVENTION

1. Field of the Invention

The present invention relates to a golf address deviation detecting apparatus for detecting inaccuracies in loft angle, lie angle, and face orientation upon address by a golf club.

2. Description of Related Art

FIG. 45 through FIG. 53 show the related art. There are typically known a loft angle, a lie angle, and a face orientation as factors for analyzing address by a golf club. As shown in FIG. 45, the "loft angle" is an angle defined between a face and an uprighted shaft of a golf putter as a golf club when viewed from a lateral or near side of the golf club, upon address by the golf club. Further, as shown in FIG. 46, the "lie angle" is an angle defined between the shaft and a ground surface when viewed from a front side of the golf putter upon address by the golf club.

There will be explained inaccuracies in loft angle, lie angle, and face orientation. For example, in case of putting on a green, there is determined an ideal address upon putting so that ideal loft angle, lie angle, and face orientation are also determined, depending on conditions upon putting, such as an undulation of the green, a grain direction and a hardness of a turf, a distance from a putting location to a hole, and a body type and an address-form of a golfer.

The "inaccuracy in loft angle" refers to a difference between an actual loft angle by a golf form and an ideal loft angle. Further, the "inaccuracy in lie angle" refers to a difference between an actual lie angle by the golf form and an ideal loft angle. Furthermore, the "inaccuracy in face orientation" refers to a difference between an actual face orientation by the golf form and an ideal face orientation.

In turn, inaccuracies in loft angle, lie angle, and/or face orientation are caused in: a situation where selection of a golf club is incorrect; a situation where selection of a golf club is correct, but inaccuracy is caused in a golf form, thereby resultingly and possibly causing inaccuracies in loft angle, lie angle, and/or face orientation; and/or the like situations.

There will be now explained a problem in case of occurrence of inaccuracy in face orientation. FIG. 47(*b*) shows a situation where a face orientation is accurate. FIG. 47(*a*) and FIG. 47(*c*) show situations where inaccuracies are caused in face orientations, respectively. Although the face orientation is directed toward a hole in case of accuracy shown in FIG. 47(*b*), face orientations are not directed toward the hole so that face orientations are wrong in case of inaccuracies shown in FIG. 47(*a*) and FIG. 47(*c*).

There will be next explained a problem in case of occurrence of inaccuracy in loft angle. FIG. 48(*b*) shows a situation where a loft angle is 0 (zero) degree. FIG. 48(*a*) shows a situation of a typical loft angle. FIG. 48(*c*) shows a situation of a large loft angle. In this way, different loft angles lead to different hitting directions of balls, respectively, such that inaccuracies in loft angle largely affect putting distances in golf.

There will be now explained a problem in case of occurrence of inaccuracy in lie angle. In case of occurrence of inaccuracy in lie angle, such an inaccuracy is problematically actualized into inaccuracies in face orientation and loft angle.

Firstly, there will be explained a reason why inaccuracy in lie angle is actualized into inaccuracy in face orientation. FIG. 49(*a*) shows a state of a face viewed from a front side thereof, upon putting a ball. FIG. 49(*a*) shows a face in an accurate state by a solid line, and a face in a heel-up state by a dotted line. FIG. 49(*b*) shows inclinations of cutting intersections between the faces and a horizontal plane S shown in FIG. 49(*a*), in a manner viewed from the above. FIG. 49(*b*) shows the cutting intersection of the face in the accurate state by a solid line. Further, FIG. 49(*b*) shows the cutting intersection of the face in the heel-up state by a dotted line. As shown in FIG. 49(*b*), the cutting intersection of the face in the heel-up state is inclined, with respect to the cutting intersection of the face in the accurate state. This leads to such a phenomenon that although a ball putted by the face in the accurate state is allowed to roll in a direction (represented by a solid line in the figure) toward a hole, a ball putted by the face in the heel-up state is rolled in a direction (represented by a dotted line in the figure) deviated from the hole direction. Namely, occurrence of inaccuracy in lie angle problematically leads to occurrence of inaccuracy in face orientation.

Next, there will be explained a reason why inaccuracy in lie angle is actualized into inaccuracy in loft angle, based on FIG. 50. FIG. 50(*a*) shows a state of a face viewed from a front side thereof, upon putting a ball. FIG. 50(*a*) shows a face in an accurate state by a solid line, and a face in a heel-up state by a dotted line. FIG. 50(*b*) shows inclinations of cutting intersections between the faces and a vertical plane T shown in FIG. 50(*a*), in a manner viewed from a lateral side (arrowed direction). FIG. 50(*b*) shows the inclination of the face in the accurate state by a solid line. Further, FIG. 50(*b*) shows the inclination of the face in the heel-up state by a dotted line. As shown in FIG. 50(*b*), the cutting intersection of the face in the heel-up state is inclined, with respect to the cutting intersection of the face in the accurate state. This leads to such a phenomenon that although a ball putted by the face in the accurate state is allowed to roll after passing through a direction represented by a solid line in the figure, a ball putted by the face in the heel-up state is rolled after passing through a direction represented by a dotted line in the figure. Namely, occurrence of inaccuracy in lie angle problematically leads to occurrence of inaccuracy in loft angle.

On the other hand, inaccuracies in loft angle, lie angle, and face orientation upon address by golf club may be caused by incorrect selection of the golf club.

As explained above, inaccuracies in loft angle, lie angle, and face orientation may be each independently caused or may be caused in a mutually affected manner. It has been thus difficult to detect as to which of inaccuracies in loft angle, lie angle, and face orientation, inaccuracy in a ball-hitting direction is caused by. As such, it has been difficult to appropriately correct a golf form and to select a golf club suitable for a golfer.

In this respect, JP-A-2002-159606 has disclosed an invention related to a putting practice tool for detecting inaccuracies in a golf form.

The putting practice tool is configured to include a double-faced adhesive tape pasted to a reverse surface of a reflection plate, and the reflection plate is stuck on a face of a putter, such that laser light irradiated from a laser light source is reflected by the reflection plate and then projected onto a projection plate.

According to JP-A-2002-159606, upon occurrence of inaccuracies in a golf form, it is certainly possible to detect such inaccuracies based on a position of reflectedly projected light on the projection plate, which position is deviated from an accurate position of the reflectedly projected light. However, it is impossible to conduct the detection to such an extent to detect as to which of inaccuracies in loft angle, lie angle, and face orientation the inaccuracies in the golf form are caused by. In this way, inaccuracies in the golf form have not been specified, thereby problematically making it difficult to correct the golf form.

In this concern, it is possible to provide a face of a golf club with a light emitting unit so as to project light irradiated from the light emitting unit onto a light receiving area, thereby detecting deviations in golf address based on a position of the projected light on the light receiving area. However, similarly to JP-A-2002-159606, although it is then certainly possible to detect inaccuracies in a golf form, it is impossible to conduct the detection to such an extent to clearly detect as to which of inaccuracies in loft angle, lie angle, and face orientation the inaccuracies in the golf form are caused by.

Further, FIG. 51 through FIG. 53 schematically show a golf address deviation detecting apparatus, which has been already practiced. The apparatus is configured to include an apparatus body 102 provided with a light irradiating unit 101, and a light reflection plate 103 provided at a face of a putter 104 so as to reflect point-shaped laser light irradiated from the light irradiating unit 101, in a manner to project the laser light reflected by the light reflection plate 103 onto a light receiving area 105.

The apparatus is intended to detect inaccuracies in a golf form based on the position of the light projected onto the light receiving area 105, as described later.

FIG. 53 shows positions of projected light in situations where a loft angle, a lie angle, and a face orientation are accurate, and situations where inaccuracies are caused in them. In FIG. 53, black dots represent positions of projected light, respectively.

However, in FIG. 53 concerning the related art, even by comparing the situations of accuracy and inaccuracies in lie angle with the situations of accuracy and inaccuracies in face orientation, the positions of the projected light in case of occurrence of inaccuracies in lie angle are the same as the positions of the projected light in case of occurrence of inaccuracies in face orientation as apparent from FIG. 53, so that both cases can not distinguished from each other.

Such a phenomenon is caused by the fact that inaccuracies in lie angle are actualized into inaccuracies in face orientation, as described above.

SUMMARY OF THE INVENTION

The present invention has been carried out in view of the problem in the related art, and it is therefore an object of the present invention to provide a golf address deviation detecting apparatus capable of detecting as to which of inaccuracy in loft angle, inaccuracy in lie angle, and inaccuracy in face orientation, inaccuracy, if any, occurred upon address by golf club is caused by. By accurately detecting such a deviation(s) upon address by golf club, it becomes possible to correct an error(s) of a form of a golfer, to adjust a club in a manner matched with a golfer, and/or to correct an error of golf club selection.

The invention recited in claim 1 resides in a golf address deviation detecting apparatus for detecting inaccuracies in loft angle, lie angle, and face orientation upon address by a golf club, the apparatus comprising:

multiple light reflecting sections in flat shapes arranged on a face of the golf club; and light irradiating units configured to irradiate light-beams onto the light reflecting sections, respectively;

wherein the light reflecting sections are arranged in positions where extensions of the planes of the light reflecting sections are intersected with each other; and wherein the apparatus is capable of detecting inaccuracies in loft angle, lie angle, and face orientation and distinguishing them from one another upon address of the golf club, based on differences among patterns of the light-beams reflected by the light reflecting sections, respectively.

The invention recited in claim 2 resides in the golf address deviation detecting apparatus of claim 1, wherein the light reflecting sections are arranged in a vertical direction or horizontal direction.

The invention recited in claim 3 resides in the golf address deviation detecting apparatus of claim 1, wherein the light irradiating units output light-beams in point-shaped cross-sectional shapes and irradiate them onto the light reflecting sections, respectively; and wherein the differences among patterns of the reflected light-beams are differences among positions of the reflected light-beams on a light receiving area.

The invention recited in claim 4 resides in the golf address deviation detecting apparatus of claim 1, wherein the light irradiating units output light-beams in line-shaped cross-sectional shapes and irradiate them onto the light reflecting sections, respectively; and wherein the differences among patterns of the reflected light-beams are differences among positions of the reflected light-beams, differences among cross-sectional shapes of the reflected light-beams, differences among inclinations of cross-sectional shapes of the reflected light-beams, or differences among scales of cross-sectional shapes of the reflected light-beams, on a light receiving area.

The invention recited in claim 5 resides in a golf address deviation detecting apparatus for detecting inaccuracies in loft angle, lie angle, and face orientation upon address by a golf club, the apparatus comprising:

a light reflecting section arranged on a face of the golf club; and light irradiating units configured to irradiate light-beams onto the light reflecting section;

wherein the light reflecting section is formed into a curved surface shape bent convexly or concavely so that the apparatus is capable of detecting inaccuracies in loft angle, lie angle, and face orientation and distinguishing them from one another upon address of the golf club, based on differences among patterns of the light-beams reflected by the light reflecting section.

The invention recited in claim 6 resides in the golf address deviation detecting apparatus of claim 5, wherein the light reflecting section is in the curved surface shape bent in a vertical direction or horizontal direction.

The invention recited in claim 7 resides in the golf address deviation detecting apparatus of claim 5, wherein the light irradiating units output light-beams in point-shaped cross-sectional shapes and irradiate them onto the light reflecting section, respectively; and wherein the differences among patterns of the reflected light-beams are differences among positions of the reflected light-beams on a light receiving area.

The invention recited in claim 8 resides in the golf address deviation detecting apparatus of claim 5, wherein the light irradiating units output light-beams in line-shaped cross-sectional shapes and irradiate them onto the light reflecting sections, respectively; and wherein the differences among patterns of the reflected light-beams are differences among positions of the reflected light-beams, differences among cross-sectional shapes of the reflected light-beams, differences among inclinations of cross-sectional shapes of the reflected light-beams, or differences among scales of cross-sectional shapes of the reflected light-beams, on a light receiving area.

The invention recited in claim 9 resides in the golf address deviation detecting apparatus of any one of claims 1 through 8, wherein the irradiated light-beams are laser light-beams, respectively.

The invention recited in claim 10 resides in the golf address deviation detecting apparatus of any one of claims 1 through 9, further comprising a light receiving area configured to present thereon light-beams reflected by the light reflecting sections, respectively.

The invention recited in claim 11 resides in the golf address deviation detecting apparatus of any one of claims 1 through 10, further comprising scale marks provided on the light receiving area, for numericalizing inaccuracies in loft angle, lie angle, and face orientation upon address, respectively.

The invention recited in claim 12 resides in a sporting form detecting apparatus for detecting inclination angles of a hitting surface possessed by a sporting good for hitting a ball upon playing by using the sporting good, the apparatus comprising:

multiple light reflecting sections in flat shapes arranged on the hitting surface; and light irradiating units configured to irradiate light-beams onto the light reflecting sections, respectively;

wherein the light reflecting sections are arranged in positions where extensions of the planes of the light reflecting sections are intersected with each other; and wherein the apparatus is capable of detecting inclination angles in three axis directions of the hitting surface upon playing by using the sporting good, based on differences among patterns of the light-beams reflected by the light reflecting sections, respectively.

The invention recited in claim 13 resides in the sporting form detecting apparatus of claim 12, wherein the light reflecting sections are arranged in a vertical direction or horizontal direction.

The invention recited in claim 14 resides in the sporting form detecting apparatus of claim 12, wherein the light irradiating units output light-beams in point-shaped cross-sectional shapes and irradiate them onto the light reflecting sections, respectively; and wherein the differences among patterns of the reflected light-beams are differences among positions of the reflected light-beams on a light receiving area.

The invention recited in claim 15 resides in the sporting form detecting apparatus of claim 12, wherein the light irradiating units output light-beams in line-shaped cross-sectional shapes and irradiate them onto the light reflecting sections, respectively; and wherein the differences among patterns of the reflected light-beams are differences among positions of the reflected light-beams, differences among cross-sectional shapes of the reflected light-beams, differences among inclinations of cross-sectional shapes of the reflected light-beams, or differences among scales of cross-sectional shapes of the reflected light-beams, on a light receiving area.

The invention recited in claim 16 resides in a sporting form detecting apparatus for detecting inclination angles of a hitting surface possessed by a sporting good for hitting a ball upon playing by using the sporting good, the apparatus comprising:

a light reflecting section arranged on the hitting surface; and light irradiating units configured to irradiate light-beams onto the light reflecting section;

wherein the light reflecting section is formed into a curved surface shape bent convexly or concavely so that the apparatus is capable of detecting inclination angles in three axis directions of the hitting surface upon playing by using the sporting good, based on differences among patterns of the light-beams reflected by the light reflecting section.

The invention recited in claim 17 resides in the sporting form detecting apparatus of claim 16, wherein the light reflecting section is in the curved surface shape bent in a vertical direction or horizontal direction.

The invention recited in claim 18 resides in the sporting form detecting apparatus of claim 16, wherein the light irradiating units output light-beams in point-shaped cross-sectional shapes and irradiate them onto the light reflecting section, respectively; and wherein the differences among patterns of the reflected light-beams are differences among positions of the reflected light-beams on a light receiving area.

The invention recited in claim 19 resides in the sporting form detecting apparatus of claim 16, wherein the light irradiating units output light-beams in line-shaped cross-sectional shapes and irradiate them onto the light reflecting sections, respectively; and wherein the differences among patterns of the reflected light-beams are differences among positions of the reflected light-beams, differences among cross-sectional shapes of the reflected light-beams, differences among inclinations of cross-sectional shapes of the reflected light-beams, or differences among scales of cross-sectional shapes of the reflected light-beams, on a light receiving area.

The invention recited in claim 20 resides in the sporting form detecting apparatus of any one of claims 12 through 19, wherein the irradiated light-beams are laser light-beams, respectively.

The invention recited in claim 21 resides in the sporting form detecting apparatus of any one of claims 12 through 20, further comprising a light receiving area configured to present thereon light-beams reflected by the light reflecting sections, respectively.

The invention recited in claim 22 resides in the sporting form detecting apparatus of any one of claims 12 through 21, further comprising scale marks provided on the light receiving area, for numericalizing inclination angles of the hitting surface upon hitting, respectively.

According to the invention recited in claim 1, it is possible to clearly distinguish as to which of inaccuracies in loft angle, lie angle, and face orientation, inaccuracy occurred upon address by golf club is caused by, based on the patterns of the reflected light-beams.

According to the invention recited in claim 2, the light reflecting sections can be arranged in a vertical direction or horizontal direction.

According to the invention recited in claim 3, it is possible to clearly distinguish as to which of inaccuracies in loft angle, lie angle, and face orientation, inaccuracy occurred upon address by golf club is caused by, by irradiating point-shaped light-beams to the light reflecting sections, respectively.

According to the invention recited in claim 4, it is possible to clearly distinguish as to which of inaccuracies in loft angle, lie angle, and face orientation, inaccuracy occurred upon address by golf club is caused by, by irradiating line-shaped light-beams to the light reflecting sections, respectively.

According to the invention recited in claim 5, it is possible to clearly distinguish as to which of inaccuracies in loft angle, lie angle, and face orientation, inaccuracy occurred upon address by golf club is caused by, by virtue of the light reflecting section in the curved shape.

According to the invention recited in claim 6, the light reflecting section can be formed of the curved surface bent in a vertical direction or horizontal direction.

According to the invention recited in claim 7, it is possible to clearly distinguish as to which of inaccuracies in loft angle, lie angle, and face orientation, inaccuracy occurred upon address by golf club is caused by, based on the differences among positions of the reflected light-beams on a light receiving area, by irradiating the point-shaped light-beams from the light irradiating units, respectively.

According to the invention recited in claim 8, it is possible to clearly distinguish as to which of inaccuracies in loft angle, lie angle, and face orientation, inaccuracy occurred upon address by golf club is caused by, based on the differences among positions of the reflected light-beams on a light receiving area, by irradiating the line-shaped light-beams from the light irradiating units, respectively.

According to the invention recited in claim 9, it is possible to clearly distinguish as to which of inaccuracies in loft angle, lie angle, and face orientation, inaccuracy occurred upon address by golf club is caused by, by the laser light-beams.

According to the invention recited in claim 10, it is possible to provide the light receiving area configured to present thereon the reflected light-beams.

According to the invention recited in claim 11, it is possible to numericalize inaccuracies in loft angle, lie angle, and face orientation upon address of golf club.

According to the invention recited in claim 12, it is possible to detect inclinations of the hitting surface of the sporting good.

According to the invention recited in claim 13, the light reflecting sections can be arranged in a vertical direction or horizontal direction.

According to the invention recited in claim 14, it is possible detect inclinations of the hitting surface of the sporting good by point-shaped light-beams.

According to the invention recited in claim 15, it is possible detect inclinations of the hitting surface of the sporting good by line-shaped light-beams.

According to the invention recited in claim 16, the light reflecting section can be formed into a curved surface shape.

According to the invention recited in claim 17, in addition to the effect of the invention in claim 16, the light reflecting section can be arranged in a vertical direction or horizontal direction.

According to the invention recited in claim 18, it is possible to detect inclinations in three axis directions of the hitting surface of the sporting good as positions of the reflected light-beams, by irradiating point-shaped light-beams.

According to the invention recited in claim 19, it is possible to detect inclinations in three axis directions of the hitting surface of the sporting good, as differences among positions of the reflected light-beams, differences among cross-sectional shapes of the reflected light-beams, differences among inclinations of cross-sectional shapes of the reflected light-beams, or differences among scales of cross-sectional shapes of the reflected light-beams, by irradiating line-shaped light-beams.

According to the invention recited in claim 20, it is possible to detect inclinations of the hitting surface of the sporting good, by laser light-beams.

According to the invention recited in claim 21, it is possible to provide the light receiving area configured to present thereon the reflected light-beams.

According to the invention recited in claim 22, it is possible to numericalize inclinations of the hitting surface of the sporting good.

BRIEF DESCRIPTION OF THE ACCOMPANYING DRAWINGS

DETAILED DESCRIPTION OF THE PREFERRED EMBODIMENTS

Figure 1:
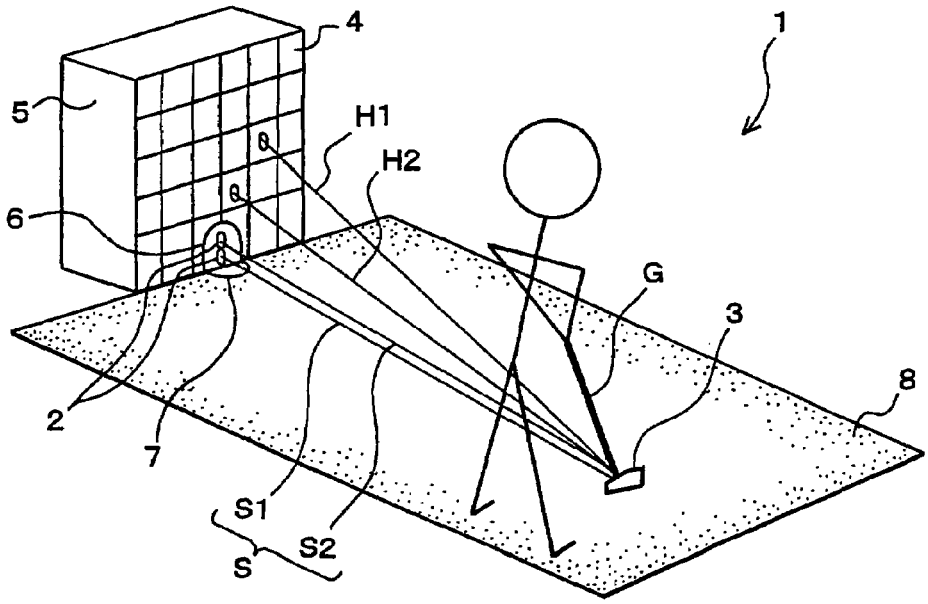
FIG. 1 is a schematic view of a golf address deviation detecting apparatus according to a first embodiment in a state that a customer is in a posture of address in front of the detecting apparatus.
Figure 2:
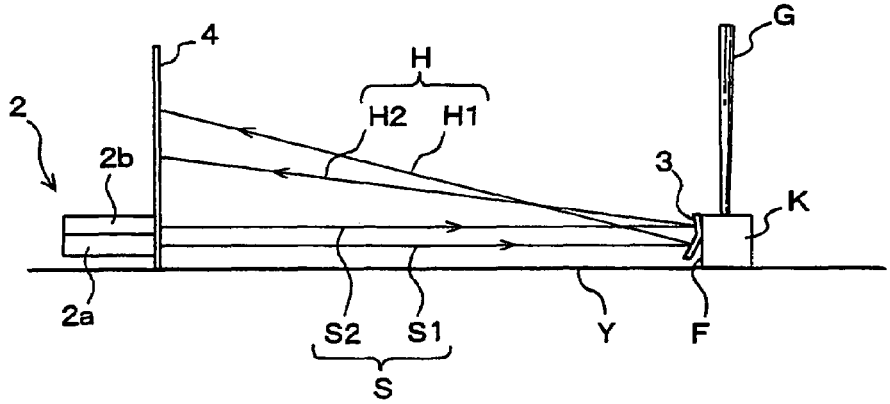
FIG. 2 is a schematic view of a positional relationship between a light irradiating unit, a light reflecting section, a light receiving area, and a golf club according to the first embodiment.
Figure 3:
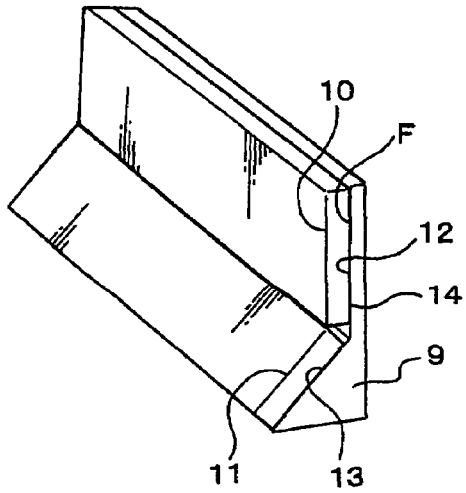
FIG. 3 is a perspective view of a face in a state provided with the light reflecting section according to the first embodiment.

FIG. 1 through FIG. 12 show a first embodiment. FIG. 1 is a perspective view of a golf address deviation detecting apparatus 1, showing a state that a customer is in a posture of address in front of the deviation detecting apparatus 1 by setting a golf club G. FIG. 2 is a schematic view showing a positional relationship between a light irradiating unit 2, a light reflecting section 3, and a light receiving area 4. FIG. 3 is a perspective view of the light reflecting section 3. FIG. 4 through FIG. 12 are explanatory views of the operation.

As shown FIG. 1 through FIG. 3, the golf address deviation detecting apparatus 1 includes the light irradiating unit 2 for irradiating light-beams S, the light reflecting section 3 for reflecting the irradiated light-beams S as reflected light-beams H, respectively, and the light receiving area 4 for presenting thereon the light-beams H reflected by the light reflecting section 3.

The light irradiating unit 2 is accommodated within a casing 5. The light irradiating unit 2 is an optical equipment configured to output irradiated light-beams S toward the light reflecting section by turning on a switch for an electric-power source (not shown).

As shown in FIG. 2, the light reflecting section 3 is provided on a face F of the golf club G, by means of adhesion, screw setting, or the like.

The casing 5 has a surface constituting the light receiving area 4.

The light receiving area 4 has an aperture 6 formed at a lower portion of the former. The light irradiating unit 2 is provided inside the aperture 6 so that the irradiated light-beams S outputted from the light irradiating unit 2 are irradiated to the outside of the casing 5 from the aperture 6. The irradiated light-beams S are those outputted from the light irradiating unit 2, and may include applicable laser light-beams. In case of adoption of laser light-beams as irradiated light-beams S, the light irradiating unit 2 may be constituted of point lasers, for example. The "point laser" is an optical equipment configured to output laser light which is point-shaped in cross section. Note that the term "point-shape" used herein shall mean a circular, polygonal, or appropriate shape having a certain extent capable of presenting an irradiated position of laser light.

As shown in FIG. 2, the light irradiating unit comprises two light irradiating units 2*a* and 2*b* which are separatedly provided in a vertical direction, and are capable of irradiating two light-beams S1 and S2 toward the light reflecting section 3, respectively. Provided at a position where the light irradiating unit 2 is disposed, is a hole mark 7 indicating a hole position as a target position upon putting a ball. The hole mark 7 may be disposed on a golf mat 8.

Figure 4:
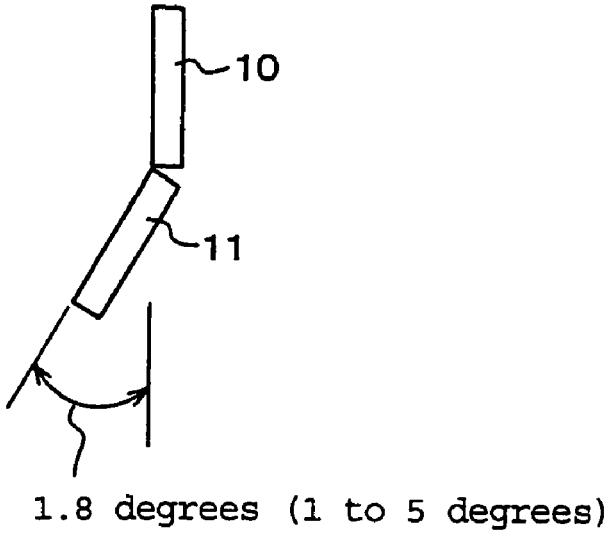
FIG. 4 is a view of an angle defined between two plane mirrors constituting the light reflecting section according to the first embodiment.

As described above, the light reflecting section 3 is attached to the face F of the golf club G, and the light reflecting section 3 is in a shape concavely bent in an up-and-down direction as shown in FIG. 3 when obliquely viewed from a front side of the golf club G in the state that the light reflecting section 3 is attached to the face F of the golf club G. As shown in FIG. 3, the light reflecting section includes a mirror pedestal 9 and two plane mirrors 10, 11. The mirror pedestal 9 has an obverse surface formed into a vertical surface 12 and an inclined surface 13, and a reverse surface formed as an attachment surface 14 configured to be attached to the face F. As shown in FIG. 4, the two plane mirrors 10, 11 are disposed to define an angle of 1.8 degrees therebetween. Here, the plane mirrors 10, 11 are formed in such sizes that the light-beams S1 and S2 are irradiated to the plane mirrors 10, 11, one by one.

Further, as shown in FIG. 1, the light receiving area 4 has a surface having vertical lines and horizontal lines drawn thereon, thereby facilitating recognition of positions of reflected light-beams H impinging on the surface of the light receiving area 4.

There will be explained a positional relationship between the light irradiating unit 2, light reflecting section 3, and light receiving area 4, with reference to FIG. 1 and FIG. 2. As shown in FIG. 1, it is assumed that a customer is in a posture of address by setting the golf club G so as to put a ball toward the hole mark 7.

As shown in FIG. 2, irradiated light-beams S1 and S2 outputted from the light irradiating unit 2 are provided in paths, respectively, that are parallel to a floor Y and that impinge on the face F of the golf club G set by the customer, from a front side of the face F. Further, the light receiving area 4 is provided in a size capable of recognizing positions which the light-beams H reflected from the light reflecting section 3 provided on the golf club G arrive at.

There will be explained the operation. As shown in FIG. 1, the customer takes a posture of address by setting the golf club G. Thereafter, the electric-power source switch of the light irradiating unit 2 is turned on to irradiate light-beams S1 and S2 from the light irradiating unit 2.

The irradiated light-beams S1 and S2 are reflected by the light reflecting section 3 provided on the face F of the golf club G, and turned into reflected light-beams H1, H2 which reach the light receiving area 4 and are presented thereon.

It is now assumed that the loft angle, lie angle, and face orientation by the golf club G upon address are all accurate without inaccuracies.

Figure 5:
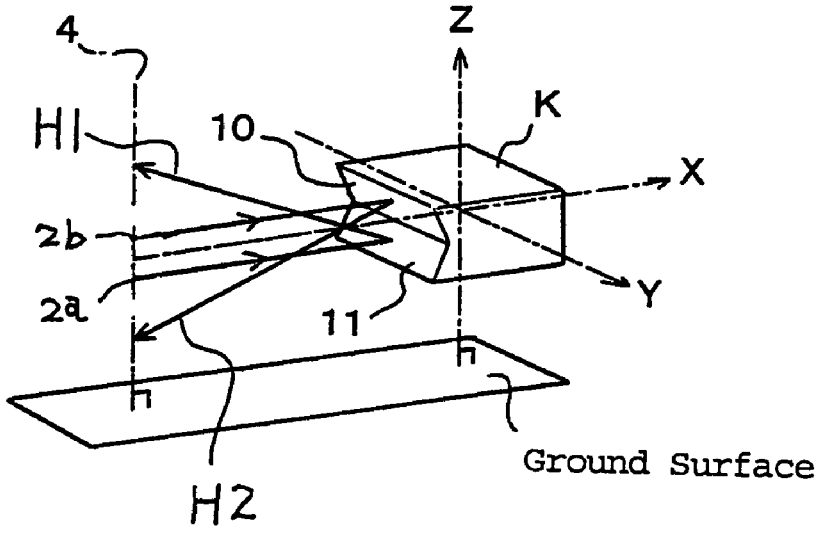
FIG. 5 is a front perspective view of the face according to the first embodiment.
Figure 6:
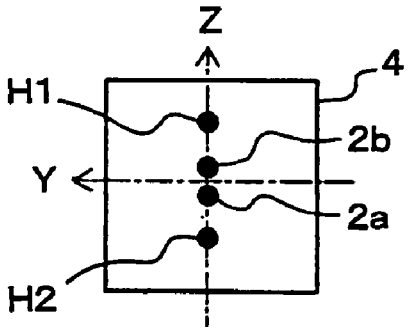
FIG. 6 is a schematic view of a positional relationship between a positional pattern of reflected light-beams presented on the light receiving area, and the light irradiating unit according to the first embodiment.

In this case, the golf club G exhibits its club head K without causing any deviations (displacements) about an X-axis, a Y-axis, and a Z-axis as shown in FIG. 5. FIG. 6 is a state diagram overlappingly showing positions of two reflected light-beams H1, H2 arriving at the light receiving area 4, and positions of the two light irradiating units 2*a* and 2*b*. In this way, when the golf address of the customer is accurate, the two irradiated light-beams S1 and S2 are reflected by the light reflecting section 3 as shown in FIG. 5 and presented on the light receiving area 4, and the thus presented positions have a relationship therebetween as shown in FIG. 6 where the presented positions are vertically aligned with each other in a manner to interpose the two light irradiating units 2*a* and 2*b* therebetween.

Figure 7:
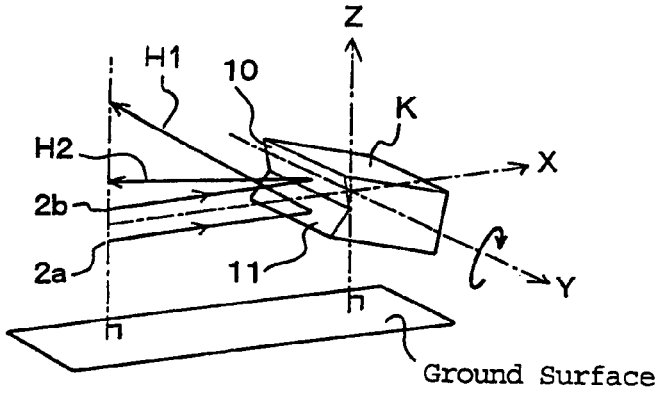
FIG. 7 is a perspective view of the light reflecting section in a state reflecting light-beams according to the first embodiment.
Figure 8:
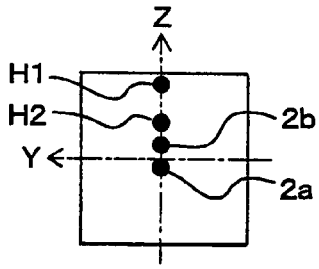
FIG. 8 is a schematic view of a positional relationship between a pattern of reflected light-beams projected onto the light receiving area, and the light irradiating unit according to the first embodiment.

Next, assuming that inaccuracy is caused in loft angle of the golf address of the customer, the club head K has caused a deviation in a manner to be rotated about the Y-axis as shown in FIG. 7. In this case, the two irradiated light-beams S1 and S2 are reflected by the light reflecting section 3 and presented on the light receiving area 4 as shown in FIG. 7, and the thus presented positions have a relationship therebetween as shown in FIG. 8 where the presented positions are vertically aligned with each other above the two light irradiating units 2*a* and 2*b* therebetween.

Figure 9:
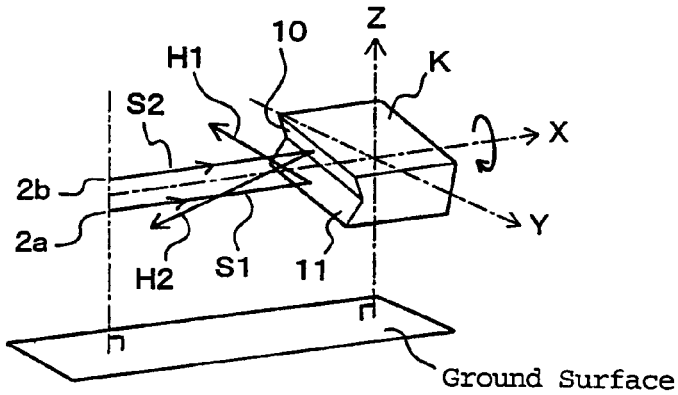
FIG. 9 is a perspective view of the light reflecting section in a state providing reflected light-beams according to the first embodiment.
Figure 10:
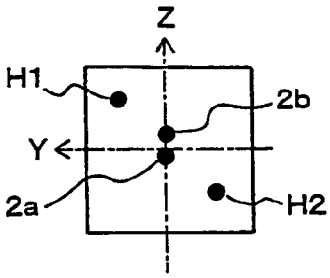
FIG. 10 is a schematic view of a positional relationship between a pattern of reflected light-beams projected onto the light receiving area, and the light irradiating unit according to the first embodiment.

In turn, assuming that inaccuracy is caused in lie angle of the golf form of the customer, the club head K has caused a deviation in a manner to be rotated about the X-axis as shown in FIG. 9. In this case, the two irradiated light-beams S1 and S2 are reflected by the light reflecting section 3 and presented on the light receiving area 4 as reflected light-beams H1, H2 as shown in FIG. 9, and the thus presented positions of the reflected light-beams H1, H2 have a relationship therebetween as shown in FIG. 10 where the presented positions are obliquely aligned with each other in a manner to interpose the two light irradiating units 2*a* and 2*b* therebetween.

Figure 11:
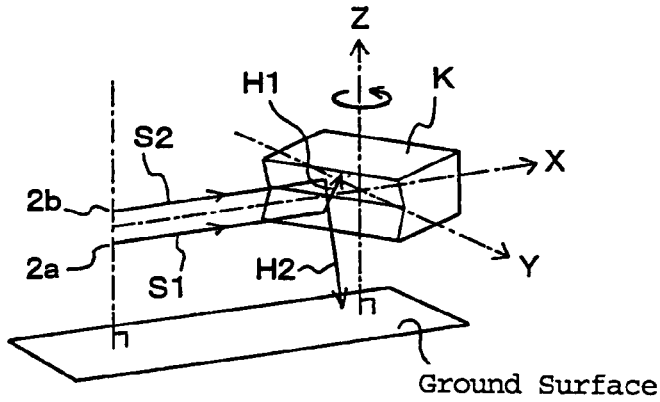
FIG. 11 is a perspective view of the light reflecting section in a state providing reflected light-beams according to the first embodiment.
Figure 12:
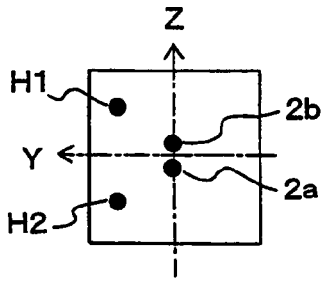
FIG. 12 is a schematic view of a positional relationship between a pattern of reflected light-beams projected onto the light receiving area, and the light irradiating unit according to the first embodiment.

Further, assuming that inaccuracy is caused in face orientation of the golf form of the customer, the club head K has caused a deviation in a manner to be rotated about the Z-axis as shown in FIG. 11. In this case, the two irradiated light-beams S1 and S2 are reflected by the light reflecting section 3 and presented on the light receiving area 4 as reflected light-beams H1, H2 as shown in FIG. 11, and the thus presented positions of the reflected light-beams H1, H2 have a relationship therebetween as shown in FIG. 12 where the presented positions are vertically aligned with each other separatedly from each other in a manner to be horizontally deviated from the two light irradiating units 2*a* and 2*b*.

As explained above, the positions of the two light irradiating units 2*a* and 2*b* and the positions of the two reflected light-beams H1, H2 are provided in different positional relationships as shown in FIG. 4 through FIG. 12, respectively, upon address of golf club, for the case of occurrence of inaccuracy in loft angle, the case of occurrence of inaccuracy in lie angle, the case of occurrence of inaccuracy in face orientation, and the case without any inaccuracies.

Namely, since the positions of the reflected light-beams H1, H2 presented on the light receiving area 4 are different from one another, it is possible to clearly distinguish the case of occurrence of inaccuracy in loft angle, the case of occurrence of inaccuracy in lie angle, the case of occurrence of inaccuracy in face orientation, and the case without any inaccuracies, from one another, based on the positional relationships among the positions of the two light irradiating units 2*a* and 2*b* and two reflected light-beams H1, H2 as shown in FIG. 4 through FIG. 12. In other words, it is possible to clearly distinguish inaccuracy in loft angle, inaccuracy in lie angle, and inaccuracy in face orientation from one another, upon address by the golf club G.

For example, in case of occurrence of inaccuracy in loft angle as shown in FIG. 7 and FIG. 8, it is possible: to bring the loft angle back into an accurate state as shown in FIG. 5 and FIG. 6, by correcting the golf form to correct the loft angle; or to bring the loft angle back into an accurate state as shown in FIG. 5 and FIG. 6, by selecting an appropriate golf club G, or by adjusting a golf club in a manner to be suited for the golf form.

In turn, in case of occurrence of inaccuracy in lie angle as shown in FIG. 9 and FIG. 10, for example, it is possible: to bring the lie angle back into an accurate state as shown in FIG. 5 and FIG. 6, by correcting the golf form to correct the lie angle; or to bring the lie angle back into an accurate state as shown in FIG. 5 and FIG. 6, by selecting an appropriate golf club, or by adjusting a golf club in a manner to be suited for the golf form. Further, in case of occurrence of inaccuracy in face orientation as shown in FIG. 11 and FIG. 12, for example, it is possible: to bring the face orientation back into an accurate state as shown in FIG. 5 and FIG. 6, by correcting the golf form to correct the face orientation; or to bring the face orientation back into an accurate state as shown in FIG. 5 and FIG. 6, by selecting an appropriate golf club for a golfer, or by adjusting a golf club in a manner to be suited for the golf form.

Figure 13:
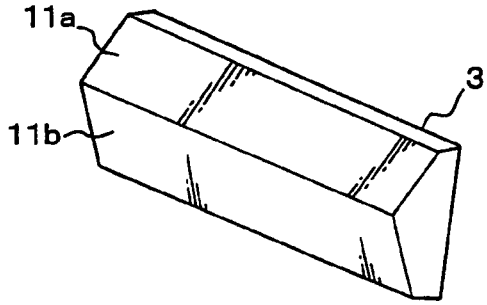
FIG. 13 is a perspective view of a light reflecting section according to a second embodiment.

FIG. 13 shows a second embodiment. The second embodiment has a feature that it includes a light reflecting section 3 formed of two light reflecting surfaces 11*a* and 11*b* in flat surface shapes, respectively, combined into a convex shape.

Also in this second embodiment and similarly to the first embodiment, the positions of the two light irradiating units 2*a* and 2*b* and the positions of the two reflected light-beams are provided in different positional relationships as shown in FIG. 4 through FIG. 12, respectively, upon address of golf club, for the case of occurrence of inaccuracy in loft angle, the case of occurrence of inaccuracy in lie angle, the case of occurrence of inaccuracy in face orientation, and the case without any inaccuracies. As such, and similarly to the first embodiment, it is possible to clearly distinguish the case of occurrence of inaccuracy in loft angle, the case of occurrence of inaccuracy in lie angle, the case of occurrence of inaccuracy in face orientation, and the case without any inaccuracies, from one another upon address of golf club, based on differences among positions of reflected light-beams presented on the light receiving area, thereby enabling a due correction.

Figure 14:
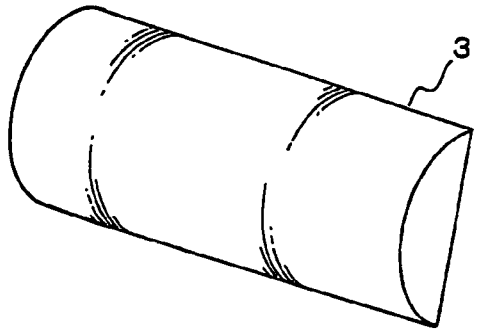
FIG. 14 is a perspective view of a light reflecting section according to a third embodiment.
Figure 15:
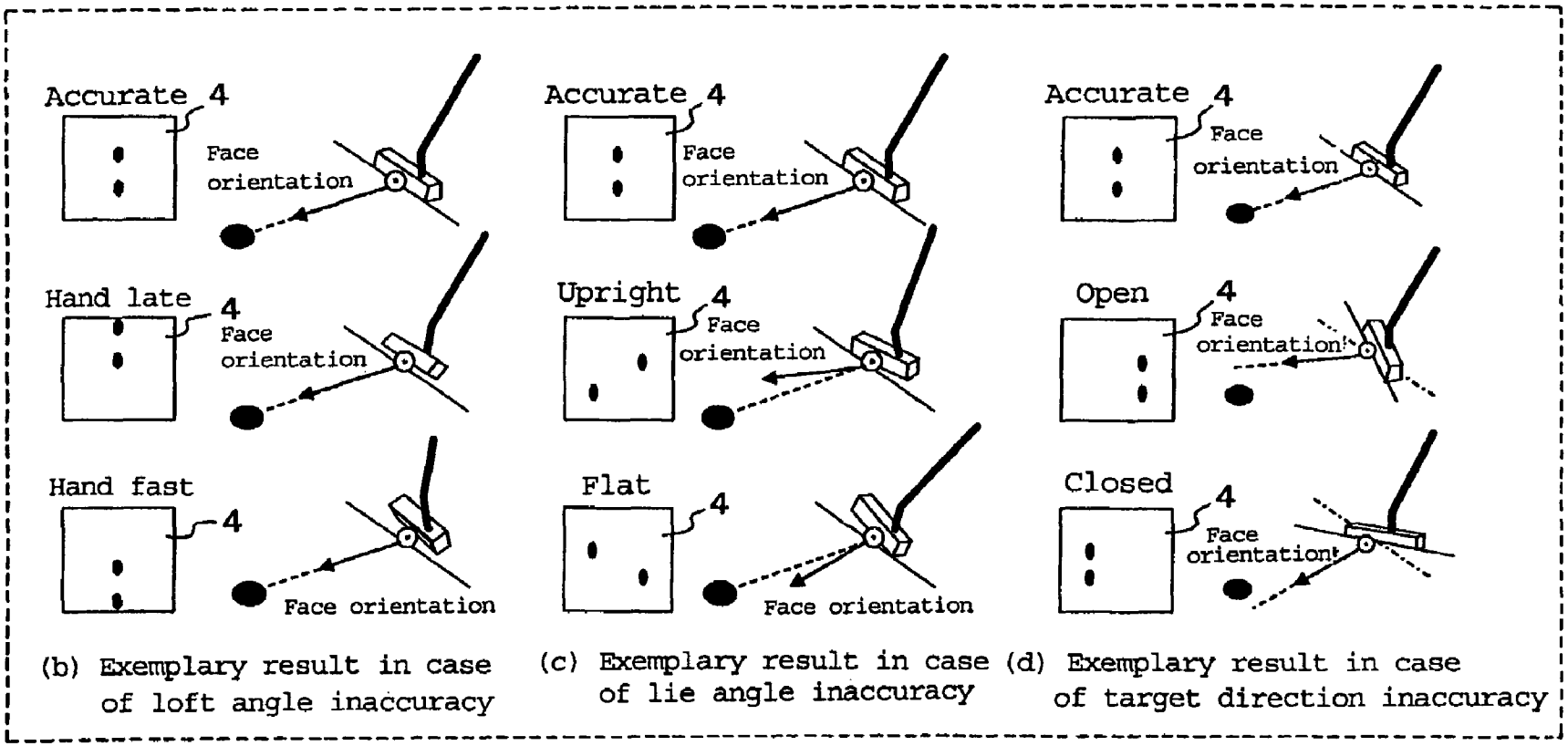
FIG. 15 is a schematic view of a positional relationship between patterns of reflected light-beams presented on the light receiving area, and the light irradiating unit according to the third embodiment.

FIG. 14 and FIG. 15 shows a third embodiment. This embodiment has a feature that it includes a light reflecting section 3 shaped to have a curved surface convexed in an up-and-down direction (arrow direction) as shown in FIG. 14. Meanwhile, two light irradiating units are provided in a vertical direction and configured to output two irradiated light-beams S1 and S2, respectively.

FIG. 15 shows black dots representing positions of reflected light-beams presented on the light receiving area 4 in the third embodiment. In the third embodiment, the positions of the two reflected light-beams presented on the light receiving area 4 are the same as those in the first embodiment. Thus, also in the third embodiment and similarly to the first embodiment, it is possible to clearly distinguish the case of occurrence of inaccuracy in loft angle, the case of occurrence of inaccuracy in lie angle, the case of occurrence of inaccuracy in face orientation, and the case without any inaccuracies, from one another upon address of golf club, based on differences among positions of reflected light-beams presented on the light receiving area. It is thus possible to exemplarily achieve correction, in the case of occurrence of inaccuracy in loft angle, in the case of occurrence of inaccuracy in lie angle, and in the case of occurrence of inaccuracy in face orientation, upon address of golf club, correspondingly to the applicable inaccuracy.

Figure 16:
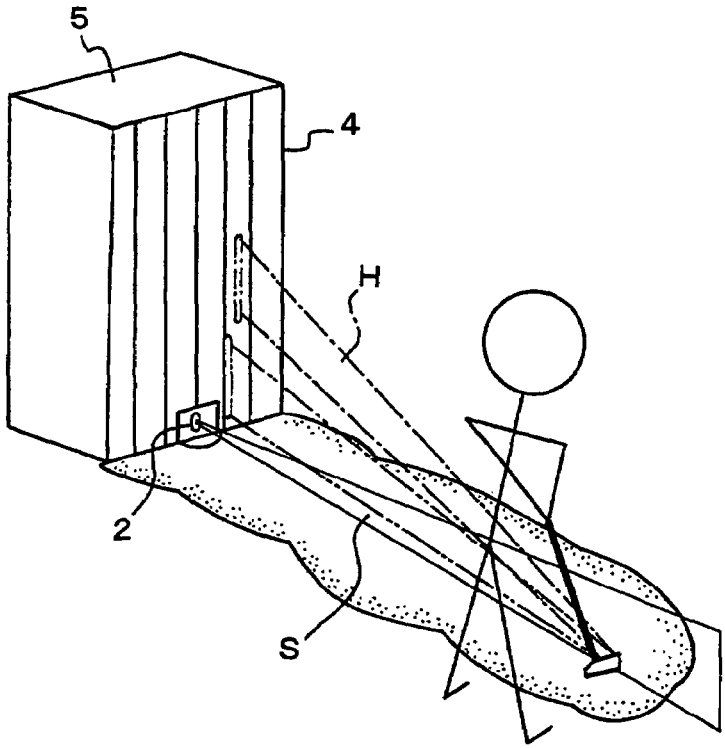
FIG. 16 is a perspective view of a fourth embodiment, similar to FIG. 1.
Figure 17:
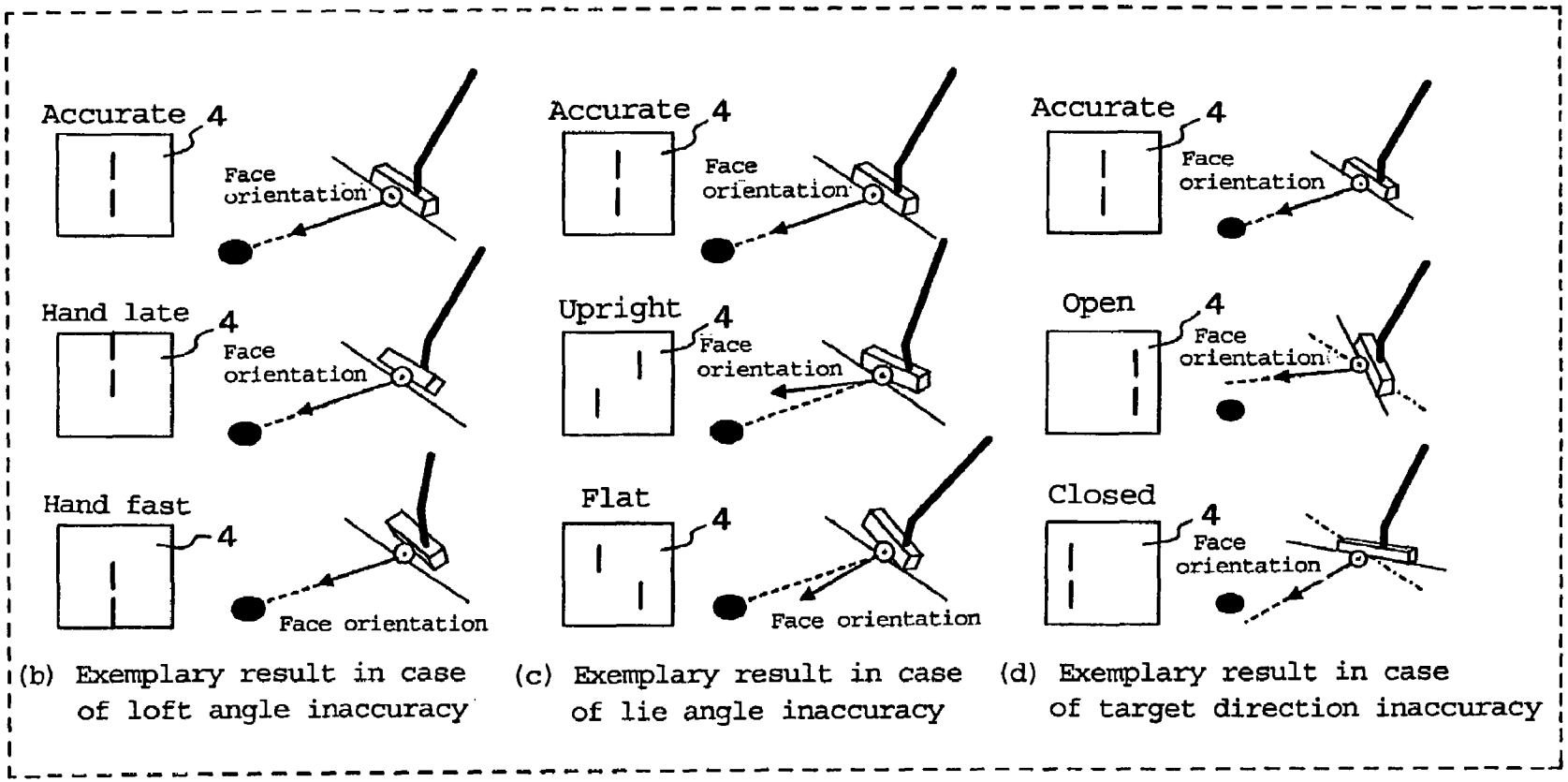
FIG. 17 is a schematic view of patterns of reflected light-beams presented on the light receiving area according to the fourth embodiment.

FIG. 16 and FIG. 17 show a fourth embodiment. As compared with the first embodiment, the fourth embodiment has a feature that it has a light irradiating unit 2 constituted of so-called line lasers each configured to output an irradiated light-beam S widened into a line shape in a vertical direction, i.e., an irradiated light-beam S linearly extended in a vertical direction. The configuration of line laser will be described later. The light reflecting section 3 is in the same shape as that of the light reflecting section 3 in the first embodiment shown in FIG. 2.

In case of an accurate loft angle as shown in FIG. 17 in the fourth embodiment, two reflected light-beams are located at positions disposed at the center in the right-and-left direction of the light receiving area 4 and arranged one above the other centrally in the up-and-down direction of the light receiving area 4. Further, in case of hand late in loft angle, the two reflected light-beams are brought into a state disposed at the center in the right-and-left direction of the light receiving area 4 and arranged one above the other in the upper region of the light receiving area 4. Meanwhile, in case of hand fast in loft angle, the two reflected light-beams are brought into a state disposed at the center in the right-and-left direction of the light receiving area 4 and arranged one above the other in the lower region of the light receiving area 4.

In case of an accurate lie angle, two reflected light-beams are located at positions disposed at the center in the right-and-left direction of the light receiving area 4 and arranged one above the other centrally in the up-and-down direction of the light receiving area 4. Further, in case of an upright lie angle, the upper reflected light-beam is rightwardly moved and the lower reflected light-beam is leftwardly moved as compared with the accurate lie angle. Meanwhile, in case of a flat lie angle, the upper reflected light-beam is leftwardly moved and the lower reflected light-beam is rightwardly moved as compared with the accurate lie angle. In this way, the two reflected light-beams are presented in a manner deviated from each other in the right-and-left direction in case of occurrence of inaccuracy in lie angle, thereby readily enabling recognition of inaccuracy in lie angle based on the positional relationship between the two reflected light-beams even in case of a slight inaccuracy in lie angle.

In case of an accurate face orientation, two reflected light-beams are located at positions disposed at the center in the right-and-left direction of the light receiving area 4 and arranged one above the other centrally in the up-and-down direction of the light receiving area 4. Further, in case of an open face orientation, the two reflected light-beams are brought into a state disposed at the center in the up-and-down direction of the light receiving area 4 and arranged one above the other in the right region of the light receiving area 4. Meanwhile, in case of a closed face orientation, the two reflected light-beams are brought into a state disposed at the center in the up-and-down direction of the light receiving area 4 and arranged one above the other in the left region of the light receiving area 4.

Also in the fourth embodiment and similarly to the first embodiment, it is possible to clearly distinguish the case of occurrence of inaccuracy in loft angle, the case of occurrence of inaccuracy in lie angle, the case of occurrence of inaccuracy in face orientation, and the case without any inaccuracies, from one another upon address of golf club, based on differences among positions of reflected light-beams presented on the light receiving area 4 as shown in FIG. 17. Namely, it is possible to clearly analyze inaccuracy in loft angle, inaccuracy in lie angle, and inaccuracy in face orientation upon address of golf club, and to distinguish them from one another. It is thus possible to correct inaccuracy in loft angle, inaccuracy in lie angle, and inaccuracy in face orientation, by correcting a golf form or by selecting an appropriate golf club.

Figure 18:
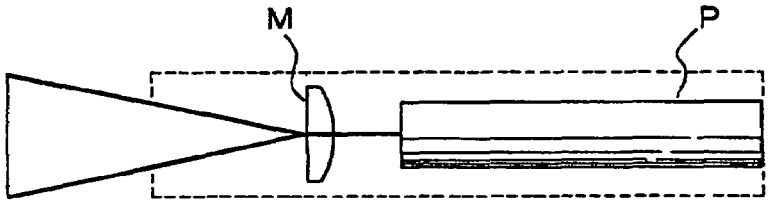
FIG. 18 is a schematic view of a configuration of a point laser.

There will be explained a configuration of the above described line laser R. As shown in FIG. 18, the line laser R is configured to include a cylindrical lens (columnar lens) in front of a point laser P. In the thus configured line laser R, point-shaped laser light outputted from the point laser P is refracted by the cylindrical lens upon passing therethrough, and widened in an up-and-down direction into a line-shape, thereby outputting line-shaped laser light.

Figure 19:
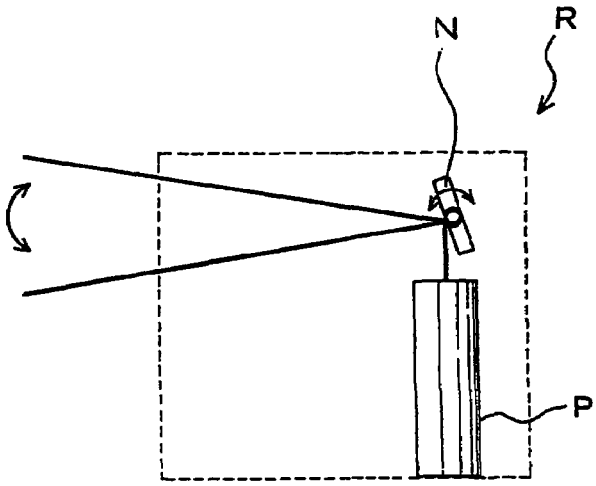
FIG. 19 is a schematic view of the configuration of the point laser.

FIG. 19 shows another configuration of the line laser R. In FIG. 19, reference character P denotes a point laser. Irradiated light-beams outputted from the point laser P are configured to be reflected by a rotational mirror N supported in a rotatable manner. In this figure, the rotational mirror N is oscillated in an arrow direction, so that laser light outputted from the point laser P and reflected by the rotational mirror is reciprocated in the arrow direction (up-and-down direction in this figure), thereby outputting line-shaped laser light.

Figure 20:
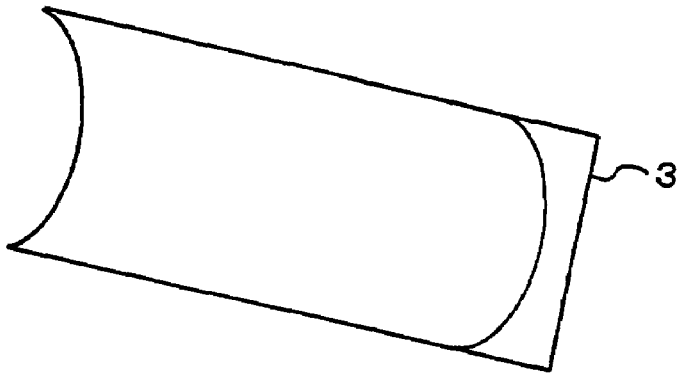
FIG. 20 is a perspective view of a light reflecting section according to a fifth embodiment.
Figure 21:
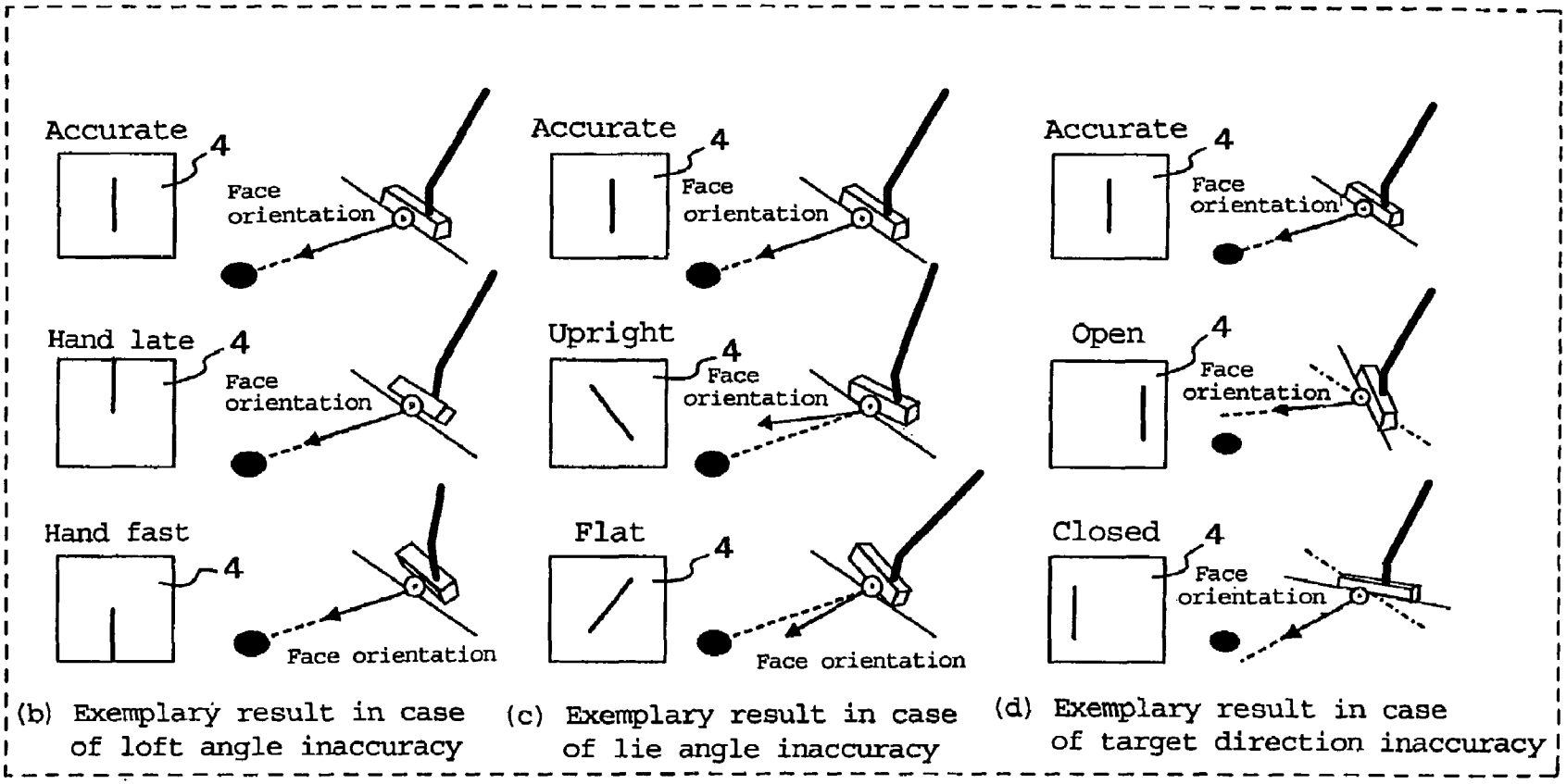
FIG. 21 is a schematic view of patterns of reflected light-beams presented on the light receiving area according to the fifth embodiment.

FIG. 20 and FIG. 21 show a fifth embodiment. As compared with the fourth embodiment, the fifth embodiment has a feature that it includes a light reflecting section 3 shaped to have a curved surface concaved in a vertical direction as shown in FIG. 20. Further, the fifth embodiment is identical to the fourth embodiment, in that the former includes a light irradiating unit 2 constituted of a single line laser R.

In case of an accurate loft angle as shown in FIG. 21 in the fifth embodiment, reflected light is presented in a vertically elongated shape at the common center in the right-and-left direction and the up-and-down direction of the light receiving area 4. Further, in case of hand late in loft angle, the reflected light is presented in a vertically elongated shape at the center in the right-and-left direction of the light receiving area 4 and in the upper region of the light receiving area 4. Meanwhile, in case of hand fast in loft angle, the reflected light is presented in a vertically elongated shape at the center in the right-and-left direction of the light receiving area 4 and in the lower region of the light receiving area 4.

In case of an accurate lie angle, reflected light is presented in a vertically elongated shape at the common center in the right-and-left direction and the up-and-down direction of the light receiving area 4. Further, in case of an upright lie angle, the reflected light is presented in an elongated shape directed downwardly and rightwardly, at the common center in the right-and-left direction and the up-and-down direction of the light receiving area 4. Meanwhile, in case of a flat lie angle, the reflected light is presented in an elongated shape directed upwardly and rightwardly, at the common center in the right-and-left direction and the up-and-down direction of the light receiving area 4. In this way, occurrence of inaccuracy in lie angle is presented as a change of inclination of a cross-sectional shape of the reflected light, thereby enabling clear recognition of the inaccuracy in lie angle.

In case of an accurate face orientation, reflected light is presented in a vertically elongated shape at the common center in the right-and-left direction and the up-and-down direction of the light receiving area 4. Further, in case of an open face orientation, the reflected light is presented in a vertically elongated shape in the right region of the light receiving area 4. Meanwhile, in case of a closed face orientation, the reflected light is presented in a vertically elongated shape in the left region of the light receiving area 4.

In this way, it is possible to clearly analyze inaccuracy in loft angle, inaccuracy in lie angle, and inaccuracy in face orientation, based on the position of the reflected light, the cross-sectional shape of the reflected light, and the like presented on the light receiving area 4. Only, the light reflecting section 3 is constituted of a continuously curved surface in the fifth embodiment, so that the reflected light presented on the light receiving area 4 is in a continuous linear shape as shown in FIG. 21 as compared with the fourth embodiment shown in FIG. 17.

Figure 22:
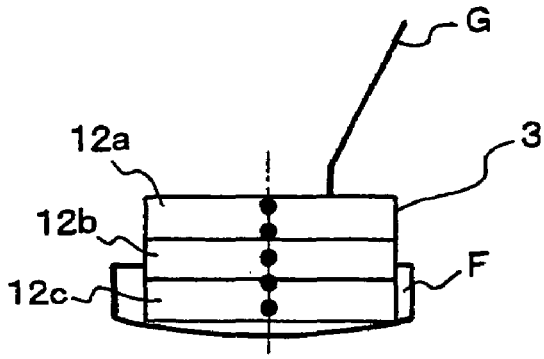
FIG. 22 is a front view of a light reflecting section according to a sixth embodiment.
Figure 23:
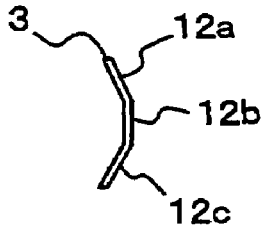
FIG. 23 is a side view of the light reflecting section according to the sixth embodiment.
Figure 24:
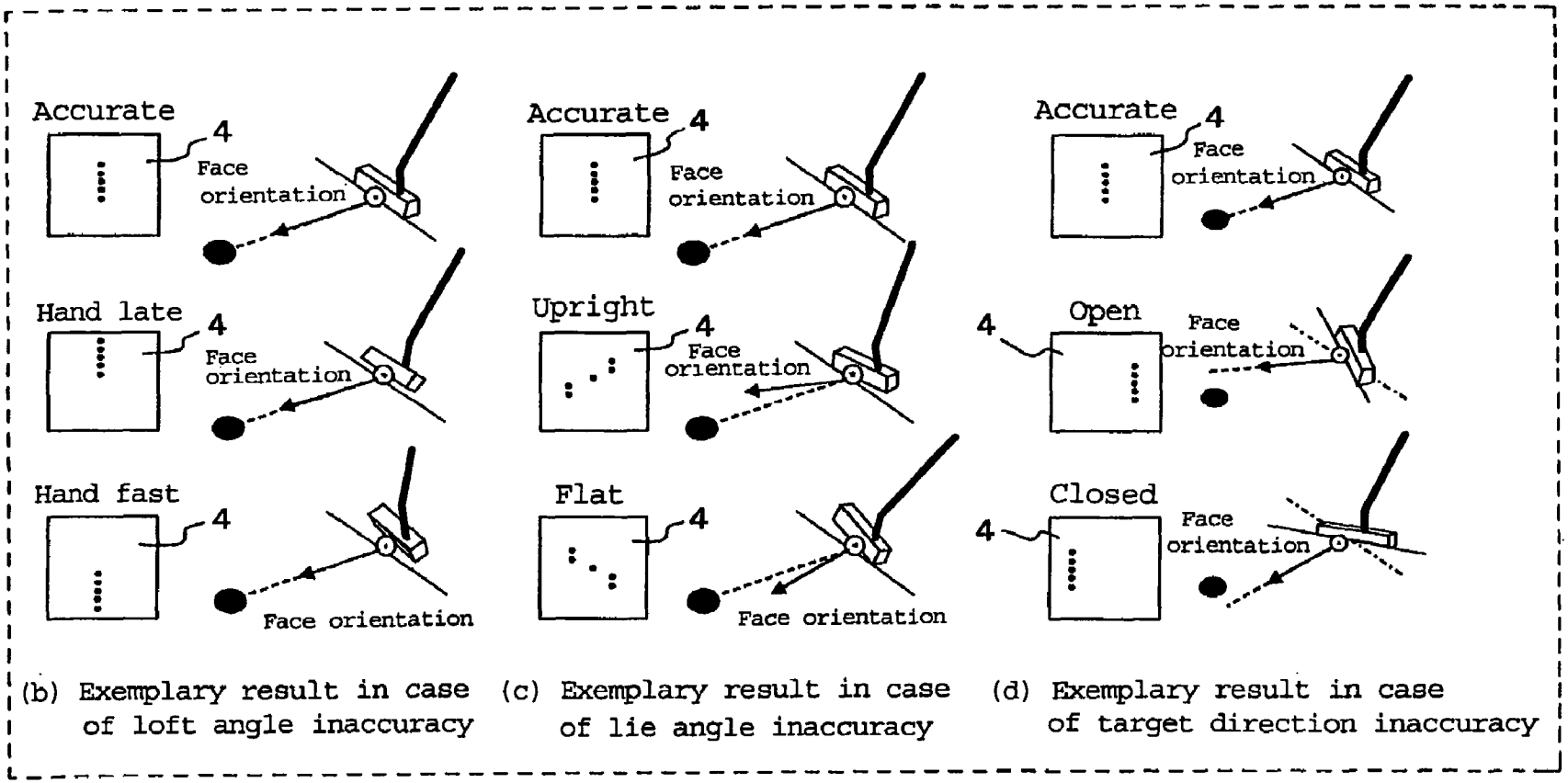
FIG. 24 is a schematic view of patterns of reflected light-beams presented on the light receiving area according to the sixth embodiment.

FIG. 22, FIG. 23, and FIG. 24 show a sixth embodiment. FIG. 22 shows a light reflecting section 3 attached to a face F of a golf club, in a state viewed from a front side of the face F. FIG. 23 is a side view of the light reflecting section 3, and FIG. 24 is a state view of reflected light-beams presented on the light receiving area 4.

The sixth embodiment has a feature that it includes five light irradiating units 2, and a light reflecting section 3 constituted of three flat surfaces 12*a*, 12*b*, and 12*c* arranged in a vertical direction. Further, as shown in FIG. 22, they have such a positional relationship that a light-beam from one of the light irradiating units is irradiated to the central flat surface 12*b*, and light-beams from the other two light irradiating units 2 are irradiated onto the other two flat surfaces 12*a* and 12*c*, respectively.

In case of an accurate loft angle as shown in FIG. 24 in the sixth embodiment, five light-beams reflected by the light reflecting section 3 appear in a state quintuply aligned in an up-and-down direction at the common center in the right-and-left direction and the up-and-down direction of the light receiving area 4. Further, in case of hand late in loft angle, the five light-beams reflected by the light reflecting section 3 appear in a state quintuply aligned in an up-and-down direction at the center in the right-and-left direction of the light receiving area 4 and in the upper region of the light receiving area 4. Meanwhile, in case of hand fast in loft angle, the five light-beams reflected by the light reflecting section 3 appear in a state quintuply aligned in an up-and-down direction at the center in the right-and-left direction of the light receiving area 4 and in the lower region of the light receiving area 4.

In case of an accurate lie angle, five light-beams reflected by the light reflecting section 3 appear in a state quintuply aligned in an up-and-down direction at the common center in the right-and-left direction and the up-and-down direction of the light receiving area 4. Further, in case of an upright lie angle, one reflected light-beam appears in a point shape at the common center in the right-and-left direction and up-and-down direction of the light receiving area 4, two reflected light-beams appear in a two-point shape at obliquely upper right of the centrally presented reflected light-beam, and the remaining two reflected light-beams appear in a two-point shape at obliquely lower left of the centrally presented reflected light-beam. In this way, the five reflected light-beams appear in a manner deviated from one another in the right-and-left direction in case of occurrence of inaccuracy in lie angle, thereby readily enabling recognition of inaccuracy in lie angle based on the positional relationship between the five reflected light-beams even in case of a slight inaccuracy in lie angle.

In case of an accurate face orientation, five reflected light-beams in point shapes appear in a state aligned in a vertical direction at the common center in the right-and-left direction and the up-and-down direction of the light receiving area 4. Further, in case of an open face orientation, five reflected light-beams in point shapes appear in a state aligned in a vertical direction at the center in the up-and-down direction of the light receiving area 4 and in the right region of the light receiving area 4. Meanwhile, in case of a closed face orientation, five reflected light-beams in point shapes appear in a state aligned in a vertical direction at the center in the up-and-down direction of the light receiving area 4 and in the left region of the light receiving area 4.

In this way, it is possible to clearly distinguish inaccuracy in loft angle, inaccuracy in lie angle, and inaccuracy in face orientation from one another in the sixth embodiment, based on differences among positions of five reflected light-beams presented on the light receiving area 4.

Figure 25:
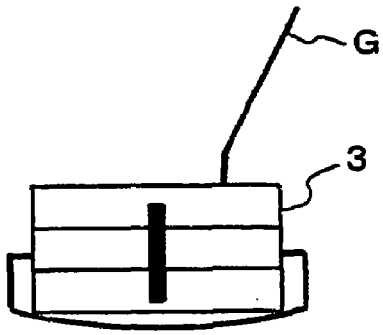
FIG. 25 is a front view of a light reflecting section according to a seventh embodiment.
Figure 26:
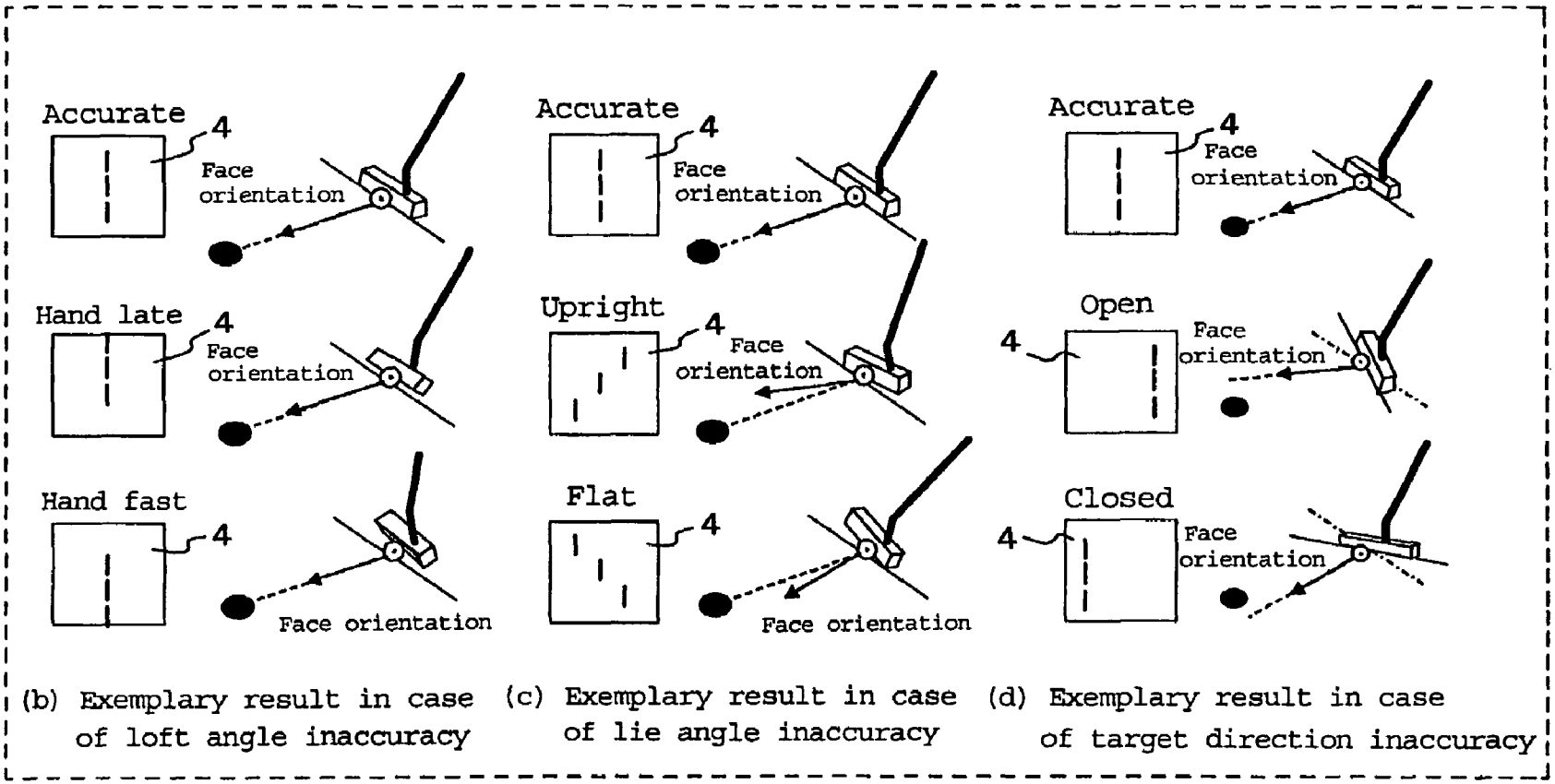
FIG. 26 is a schematic view of patterns of reflected light-beams presented on the light receiving area according to the seventh embodiment.

FIG. 25 and FIG. 26 show a seventh embodiment. As compared with the sixth embodiment, the seventh embodiment has a feature that it includes a light irradiating unit 2 constituted of a so-called line laser configured to output a light-beam linearly shaped in a vertical direction. It further includes a light reflecting section 3 constituted of three flat surfaces, similarly to the sixth embodiment.

In case of an accurate loft angle as shown in FIG. 26 in the seventh embodiment, reflected light-beams appear as three vertically elongated lines in a state aligned on a single line in an up-and-down direction at the common center in the right-and-left direction and the up-and-down direction of the light receiving area 4. Further, in case of hand late in loft angle, reflected light-beams appear as three vertically elongated lines in a state aligned on a single line in an up-and-down direction at the center in the right-and-left direction of the light receiving area 4 and in the upper region of the light receiving area 4. Meanwhile, in case of hand fast in loft angle, reflected light-beams appear as three vertically elongated lines in a state aligned on a single line in an up-and-down direction at the center in the right-and-left direction of the light receiving area 4 and in the lower region of the light receiving area 4.

In case of an accurate lie angle, reflected light-beams appear as three vertically elongated lines in a state aligned on a single line in an up-and-down direction at the common center in the right-and-left direction and the up-and-down direction of the light receiving area 4. Further, in case of an upright lie angle, reflected light-beams appear as three vertically elongated lines in a state obliquely positioned from the upper right toward the lower left of the light receiving area 4. Meanwhile, in case of a flat lie angle, reflected light-beams appear as three vertically elongated lines in a state obliquely positioned from the upper left toward the lower right of the light receiving area 4. In this way, the three reflected light-beams are presented on the light receiving area 4 in a manner deviated from one another in the right-and-left direction in case of occurrence of inaccuracy in lie angle, thereby readily enabling recognition of inaccuracy in lie angle based on the positional relationship between the three reflected light-beams even in case of a slight inaccuracy in lie angle.

In case of an accurate face orientation, the three reflected light-beams appear as three vertically elongated lines in a state aligned on a single line in an up-and-down direction at the common center in the right-and-left direction and the up-and-down direction of the light receiving area 4. Further, in case of an open face orientation, the three reflected light-beams appear in a state aligned on a single line in a vertical direction at the center in the up-and-down direction of the light receiving area 4 and in the right region of the light receiving area 4. Meanwhile, in case of a closed face orientation, three reflected light-beams appear in a state aligned on a single line in a vertical direction at the center in the up-and-down direction of the light receiving area 4 and in the left region of the light receiving area 4.

In this way, it is possible to clearly distinguish inaccuracy in loft angle, inaccuracy in lie angle, and inaccuracy in face orientation from one another in the seventh embodiment, based on differences among positions of reflected light-beams.

Figure 27:
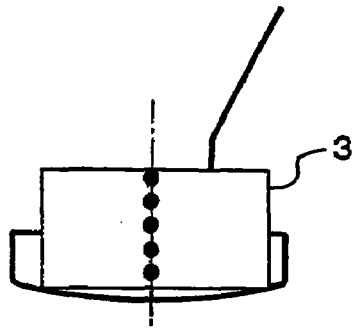
FIG. 27 is a front view of a light reflecting section according to an eighth embodiment.
Figure 28:
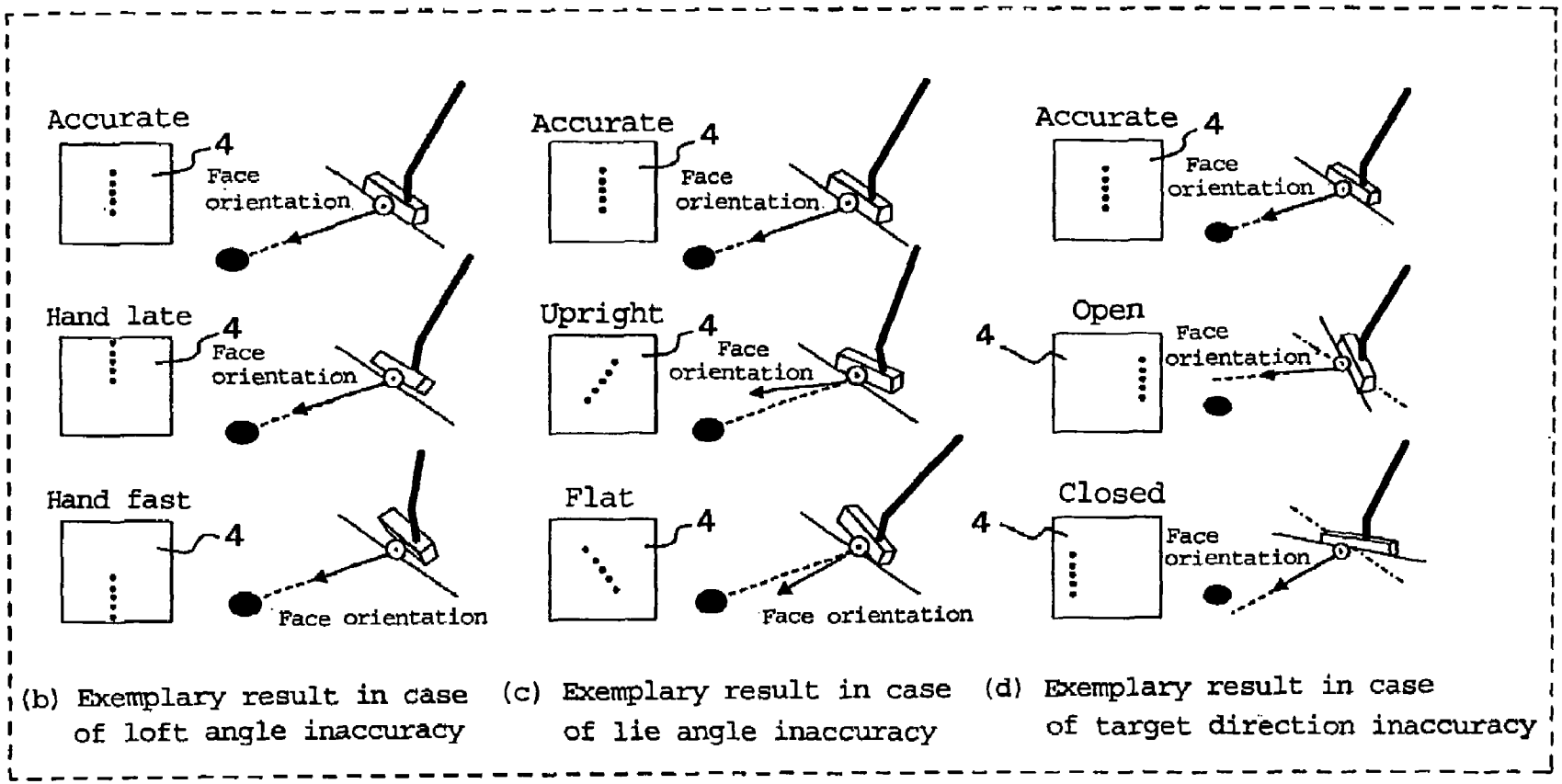
FIG. 28 is a schematic view of patterns of reflected light-beams presented on the light receiving area according to the eighth embodiment.

FIG. 27 and FIG. 28 show an eighth embodiment. As compared with the sixth embodiment, the eighth embodiment has a feature that it includes a light reflecting section 3 shaped to have a curved surface convexed in a vertical direction. The eighth embodiment is the same as the sixth embodiment, in the aspect that the former includes five light irradiating units 2 in point shapes aligned in the vertical direction to output five irradiated light-beams.

In case of an accurate loft angle as shown in FIG. 28 in the eighth embodiment, five reflected light-beams appear in a state linearly aligned in an up-and-down direction at the common center in the right-and-left direction and the up-and-down direction of the light receiving area 4. Further, in case of hand late in loft angle, the five reflected light-beams appear in a state linearly aligned in an up-and-down direction at the center in the right-and-left direction of the light receiving area 4 and in the upper region of the light receiving area 4. Meanwhile, in case of hand fast in loft angle, the five reflected light-beams appear in a state linearly aligned in an up-and-down direction at the center in the right-and-left direction of the light receiving area 4 and in the lower region of the light receiving area 4.

In case of an accurate lie angle, five reflected light-beams appear in a state linearly aligned in an up-and-down direction at the common center in the right-and-left direction and the up-and-down direction of the light receiving area 4. Further, in case of an upright lie angle, five reflected light-beams appear along an oblique line oriented from the upper right of the light receiving area 4 toward the lower left thereof, at the common center in the right-and-left direction and the up-and-down direction of the light receiving area 4. Meanwhile, in case of a flat lie angle, five reflected light-beams appear along an oblique line oriented from the upper left of the light receiving area 4 toward the lower right thereof, at the common center in the right-and-left direction and the up-and-down direction of the light receiving area 4.

In case of an accurate face orientation, five reflected light-beams appear in a state linearly aligned in an up-and-down direction at the common center in the right-and-left direction and the up-and-down direction of the light receiving area 4. Further, in case of an open face orientation, five reflected light-beams appear in a state linearly aligned in a vertical direction at the center in the up-and-down direction of the light receiving area 4 and in the right region of the light receiving area 4. Meanwhile, in case of a closed face orientation, five reflected light-beams appear in a state linearly aligned in a vertical direction at the center in the up-and-down direction of the light receiving area 4 and in the left region of the light receiving area 4.

In the eighth embodiment, it is possible to clearly distinguish inaccuracy in loft angle, inaccuracy in lie angle, and inaccuracy in face orientation from one another, based on differences among positions of five reflected light-beams appearing on the light receiving area 4.

Figure 29:
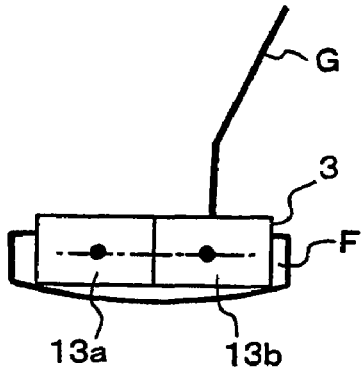
FIG. 29 is a front view of a light reflecting section according to a ninth embodiment.
Figure 30:
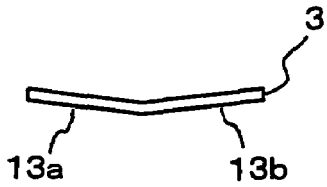
FIG. 30 is a side view of the light reflecting section according to the ninth embodiment.
Figure 31:
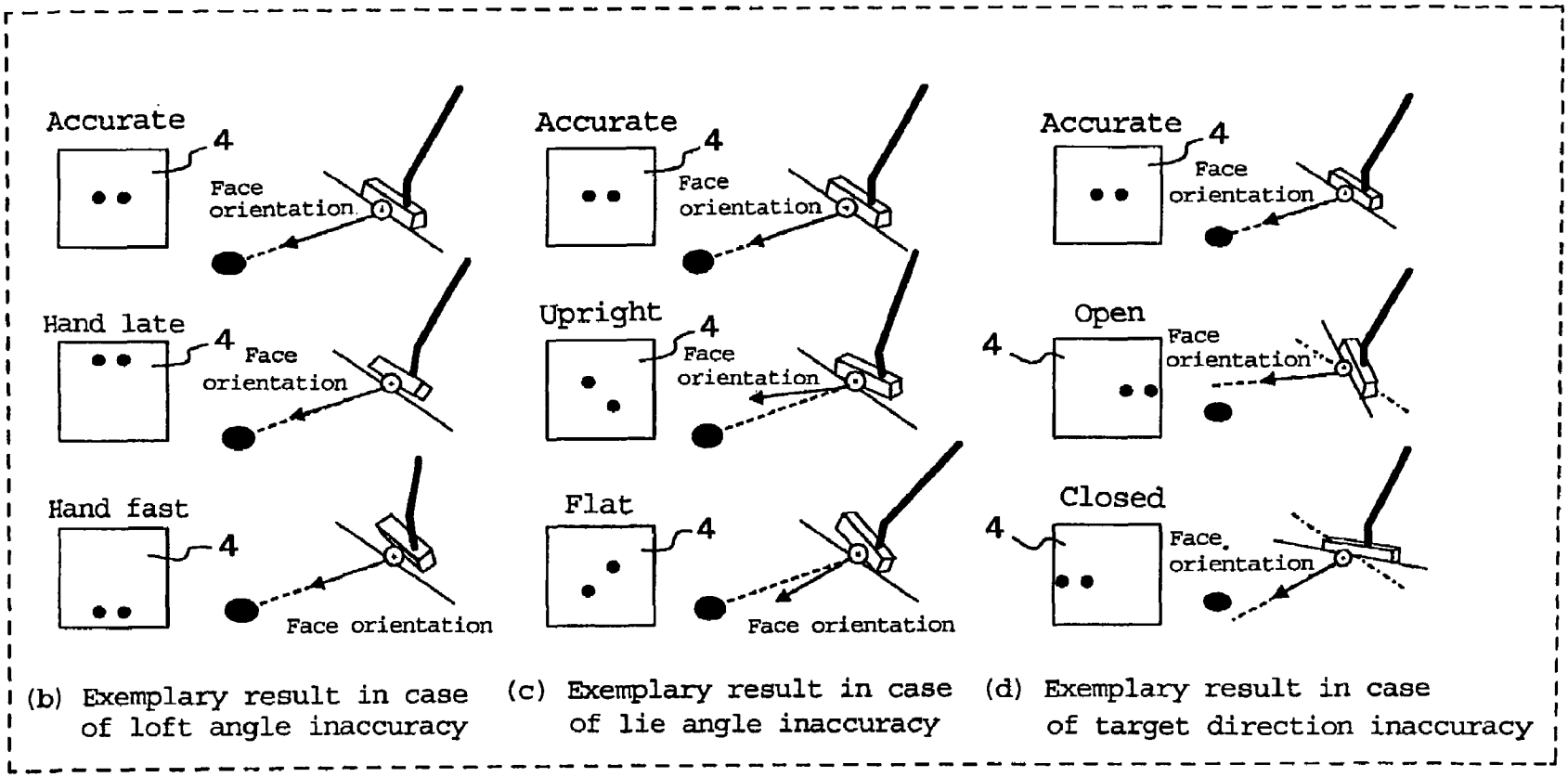
FIG. 31 is a schematic view of patterns of reflected light-beams presented on the light receiving area according to the ninth embodiment.

FIG. 29, FIG. 30, and FIG. 31 show a ninth embodiment. FIG. 29 is a front view of a light reflecting section 3 attached to a face F of a golf club G, FIG. 30 is a side view of the light reflecting section 3, and FIG. 31 is a schematic view of patterns of reflected light-beams projected onto a light receiving area 4.

The ninth embodiment has a feature that the light reflecting section 3 has a shape concavely bent in a horizontal direction as shown in FIG. 29. As shown in FIG. 30, the light reflecting section 3 can be formed of two light reflecting surfaces 13*a* and 13*b* constituted of flat surfaces, respectively, provided in an elbowed manner. Here, the light reflecting section 3 is formed into such a size that light-beams S1 and S2 are irradiated to the light reflecting surfaces 13*a* and 13*b* in a one-to-one manner. Namely, the ninth embodiment corresponds to a configuration where the light irradiating unit 2 and light reflecting section 3 in the first embodiment are arranged by rotating them by 90 degrees.

Further, in the ninth embodiment, reflected light-beams are provided in patterns provided by rotating the patterns of the reflected light-beams exemplified in the first embodiment shown in FIG. 4 through FIG. 12 by 90 degrees. Also in the ninth embodiment, it is possible to clearly and analyzingly distinguish inaccuracy in loft angle, inaccuracy in lie angle, and inaccuracy in face orientation from one another, based on differences among positions of two reflected light-beams on the light receiving area 4, similarly to the first embodiment.

Moreover, it is possible to clearly and analyzingly distinguish inaccuracy in loft angle, inaccuracy in lie angle, and inaccuracy in face orientation from one another, similarly to the first embodiment, even by rotating the light irradiating units and the reflective surfaces, not to the vertical orientations and horizontal orientations, but to orientations at arbitrary angles, respectively.

Figure 32:
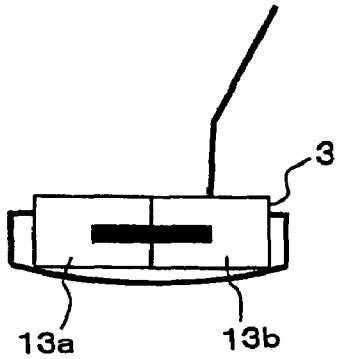
FIG. 32 is a front view of a light reflecting section according to a tenth embodiment.
Figure 33:
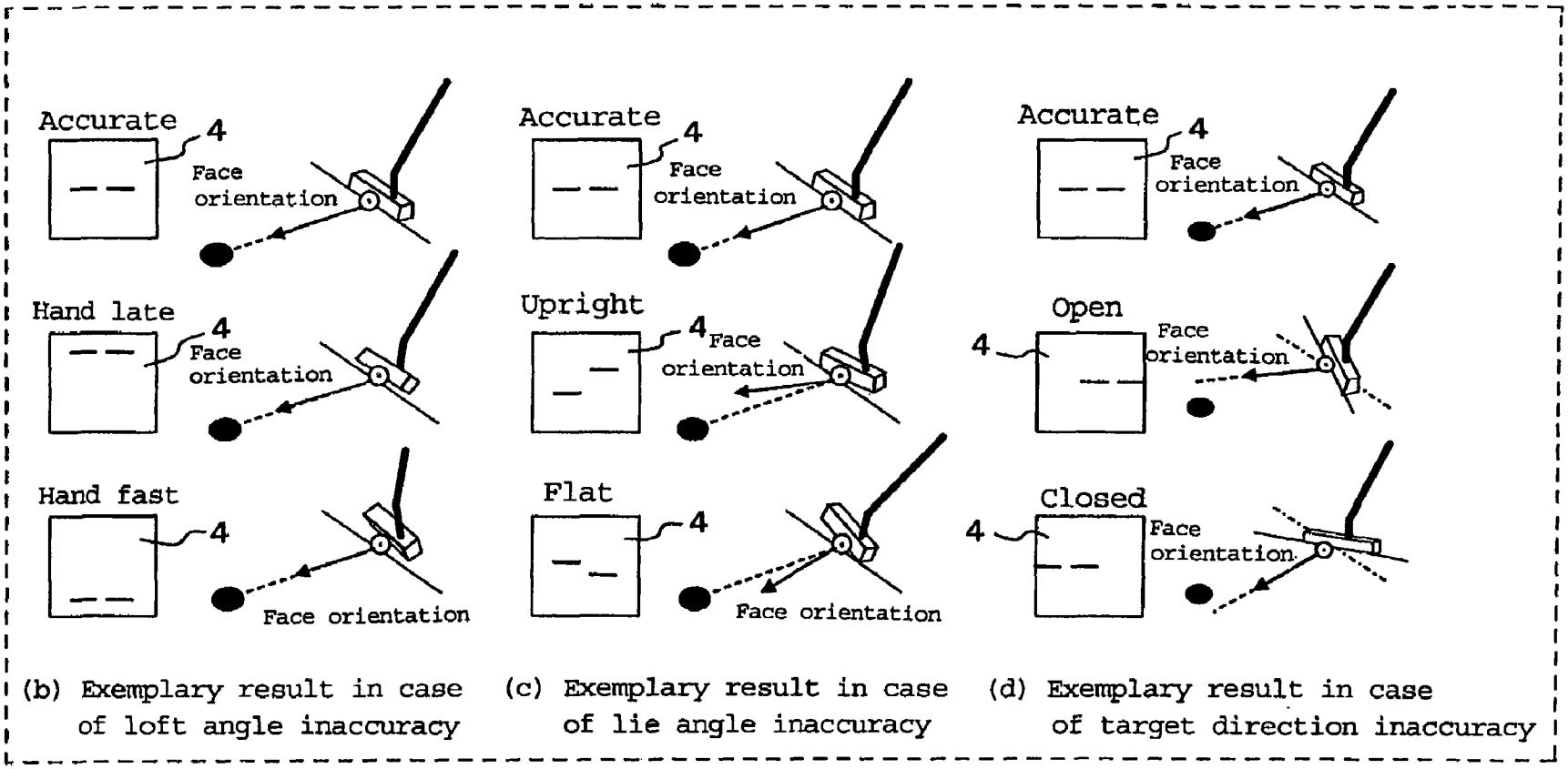
FIG. 33 is a schematic view of patterns of reflected light-beams presented on the light receiving area according to the tenth embodiment.

FIG. 32 and FIG. 33 show a tenth embodiment. The tenth embodiment has a feature that it includes the light irradiating units 2 and light reflecting section 3 of the fourth embodiment shown in FIG. 16 and FIG. 17, which units and section are rotated by 90 degrees. In the tenth embodiment, as shown in FIG. 33, it is possible to clearly distinguish inaccuracy in loft angle, inaccuracy in lie angle, and inaccuracy in face orientation from one another, based on differences among positions of reflected light-beams on the light receiving area 4, similarly to the fourth embodiment shown in FIG. 17.

Figure 34:
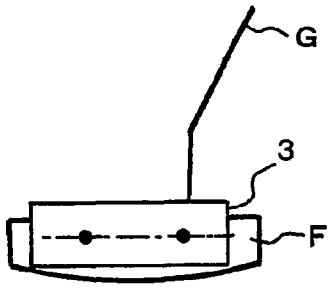
FIG. 34 is a front view of a light reflecting section according to an eleventh embodiment.
Figure 35:
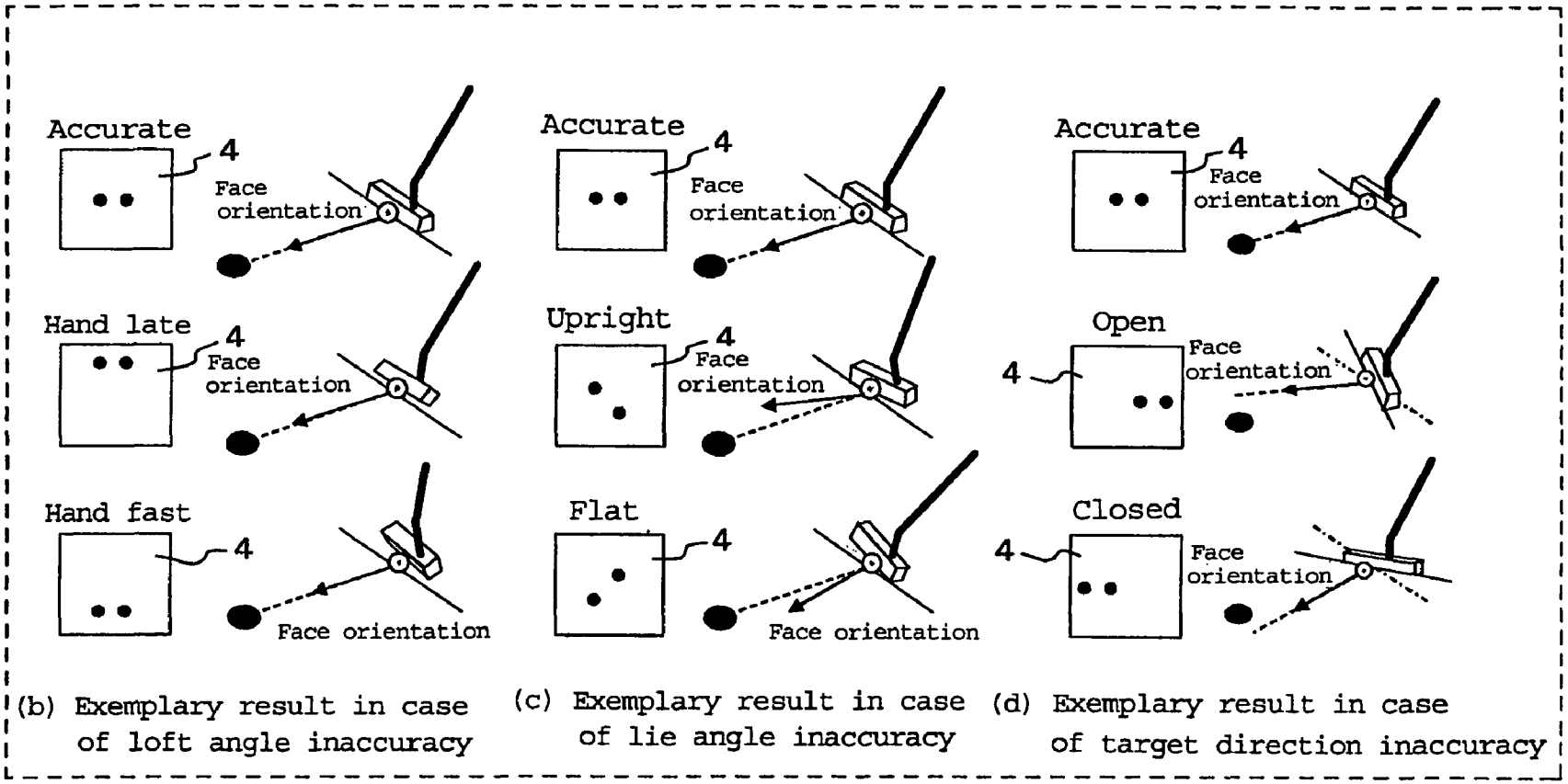
FIG. 35 is a schematic view of spectrum patterns of reflected light-beams presented on the light receiving area according to the eleventh embodiment.

FIG. 34 and FIG. 35 show an eleventh embodiment. The eleventh embodiment has a feature that it includes a light reflecting section 3 formed into a curved surface convexed or concaved in a horizontal direction. FIG. 34 is a front view of the light reflecting section 3 attached to a face F of a golf club G. The eleventh embodiment corresponds to a situation that the light irradiating units 2 and light reflecting section 3 of the third embodiment shown in FIG. 14 and FIG. 15 are arranged by rotating them by 90 degrees. FIG. 35 is a schematic view of positions of reflected light-beams presented on the light receiving area 4. FIG. 35 corresponds to a situation that the patterns of the third embodiment shown in FIG. 15 are rotated by 90 degrees. Also in the eleventh embodiment, it is possible to clearly distinguish inaccuracy in loft angle, inaccuracy in lie angle, and inaccuracy in face orientation from one another, based on differences among positions of two reflected light-beams presented on the light receiving area 4.

Figure 36:
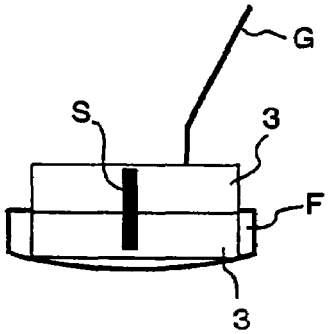
FIG. 36 is a front view of a light reflecting section according to a twelfth embodiment.
Figure 37:
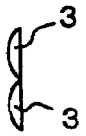
FIG. 37 is a side view of the light reflecting section according to the twelfth embodiment.
Figure 38:
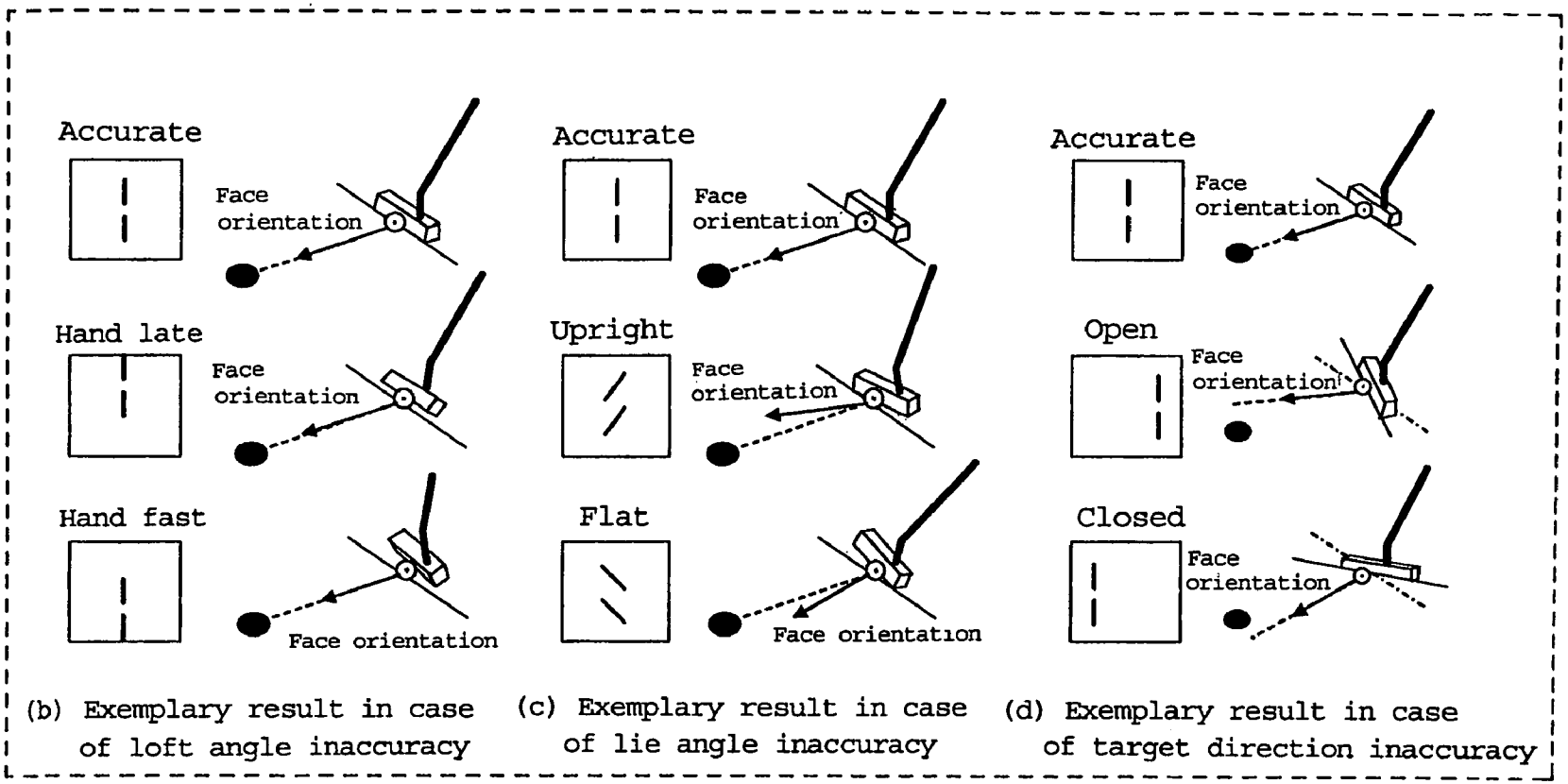
FIG. 38 is a schematic view of patterns of reflected light-beams presented on the light receiving area according to the twelfth embodiment.

FIG. 36 through FIG. 38 show a twelfth embodiment. FIG. 36 is a front view of a light reflecting section 3 attached to a face F of a golf club G. FIG. 37 is a side view of the light reflecting section 3. FIG. 38 is a schematic view of patterns of reflected light-beams presented on the light receiving area 4.

The twelfth embodiment has a feature that the light reflecting section 3 is formed of a curved surface convexed in a vertical direction, and dually provided at upper and lower levels, respectively, as shown in FIG. 37. The light irradiating units are constituted of line lasers for outputting vertically elongated laser light-beams, respectively. In the twelfth embodiment, the light irradiating units are configured to output singly irradiated light-beams S in vertically elongated line-shapes, and the irradiated light-beams S are reflected by the light reflecting sections 3, 3 such that the two reflected light-beams are presented on the light receiving area 4.

In case of an accurate loft angle as shown in FIG. 38 in the twelfth embodiment, two vertically elongated reflected light-beams appear in an aligned state at the common center in the right-and-left direction and the up-and-down direction of the light receiving area 4. Further, in case of hand late in loft angle, the two vertically elongated reflected light-beams appear in an aligned state at the center in the right-and-left direction of the light receiving area 4 and in the upper region of the light receiving area 4. Meanwhile, in case of hand fast in loft angle, the two vertically elongated reflected light-beams appear in an aligned state at the center in the right-and-left direction of the light receiving area 4 and in the lower region of the light receiving area 4.

In case of an accurate lie angle, two vertically elongated reflected light-beams appear in an aligned state at the common center in the right-and-left direction and the up-and-down direction of the light receiving area 4. Further, in case of an upright lie angle, the two reflected light-beams are presented in a manner directed upwardly and rightwardly at the common center in the right-and-left direction and the up-and-down direction of the light receiving area 4. Meanwhile, in case of a flat lie angle, the two reflected light-beams are presented in a manner directed downwardly and rightwardly at the common center in the right-and-left direction and the up-and-down direction of the light receiving area 4. In this way, occurrences of inaccuracy in lie angle also lead to inclinations of cross-sectional shapes of the reflected light-beams, respectively.

In case of an accurate face orientation, two vertically elongated reflected light-beams appear in an aligned state at the common center in the right-and-left direction and the up-and-down direction of the light receiving area 4. Further, in case of an open face orientation, the two vertically elongated reflected light-beams appear in an aligned state at the center in the up-and-down direction of the light receiving area 4 and in the right region of the light receiving area 4. Meanwhile, in case of a closed face orientation, the two vertically elongated reflected light-beams appear in an aligned state at the center in the up-and-down direction of the light receiving area 4 and in the left region of the light receiving area 4.

In case of the twelfth embodiment, it is possible to clearly distinguish inaccuracy in loft angle, inaccuracy in lie angle, and inaccuracy in face orientation from one another, based on differences among positions, inclinations of cross-sectional shapes, and the like of the two reflected light-beams presented on the light receiving area 4.

In the above embodiments, inaccuracies in loft angle, lie angle, and face orientation upon address have been distinguished from one another based on differences among positions, and/or inclinations of cross-sectional shapes of reflected light-beam(s) presented on the light receiving area 4. However, it is also possible to sense differences among inaccuracies in loft angle, lie angle, and face orientation upon address as differences among scale sizes of cross-sectional shapes of a reflected light-beam presented on the light receiving area 4, by constituting the light irradiating unit 2 by a line laser and the light reflecting section 3 by a curved surface such that the curved surface has a curvature changed along an extent of the surface in a manner to scale up or scale down a cross-sectional shape of reflected light-beam on the light receiving area 4 commensurately with inaccuracy in loft angle, lie angle, or face orientation upon address.

Further, it is possible to sense differences among inaccuracies in loft angle, lie angle, and face orientation upon address as differences among cross-sectional shapes of a reflected light-beam presented on the light receiving area 4, by constituting the light irradiating unit 2 by a line laser and the light reflecting section 3 by a curved surface such that the curved surface has a curvature changed along an extent of the surface in a manner to change a cross-sectional shape of reflected light-beam on the light receiving area 4 commensurately with inaccuracy in loft angle, lie angle, or face orientation upon address. Meanwhile, in case of providing multiple light reflecting sections 3, the light reflecting sections 3 may be joined to one another, or the light reflecting sections 3 may be virtually intersected with each other by means of extensions of the light reflecting sections 3 while leaving gaps between the light reflecting sections 3. Further, although the embodiments have been explained for the situations that the light reflecting section(s) 3 has/have been formed into convex or concave shapes in a horizontal direction or vertical direction, such convex or concave shapes may be directed in an arbitrary direction between the horizontal direction and the vertical direction.

Figure 39:
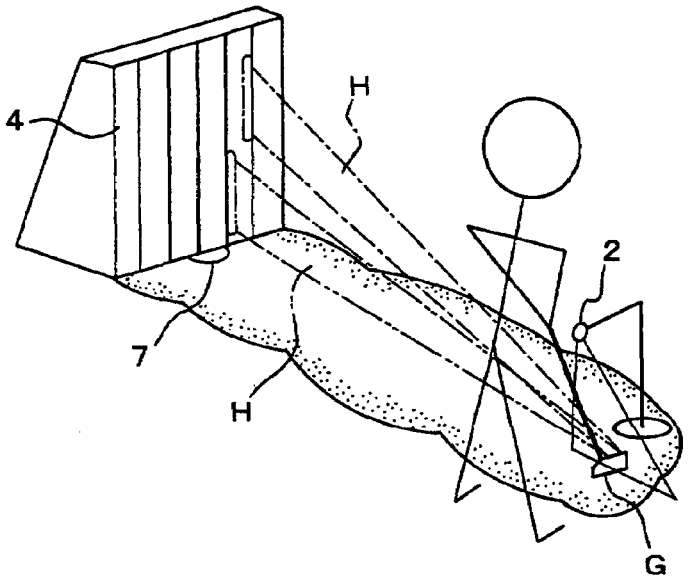
FIG. 39 is a view in a state that a customer is in a posture of address in front of a golf address deviation detecting apparatus according to a thirteenth embodiment.

FIG. 39 shows a thirteenth embodiment. The thirteenth embodiment has a feature that it includes a light irradiating unit 2 disposed above a club head K of a golf club G in a manner to irradiate light to a light reflecting section from the above of the club head K, and the reflected light is presented on the light receiving area 4. Also in the thirteenth embodiment, it is possible to clearly distinguish inaccuracy in loft angle, inaccuracy in lie angle, and inaccuracy in face orientation from one another, based on patterns of reflected light.

Figure 40:
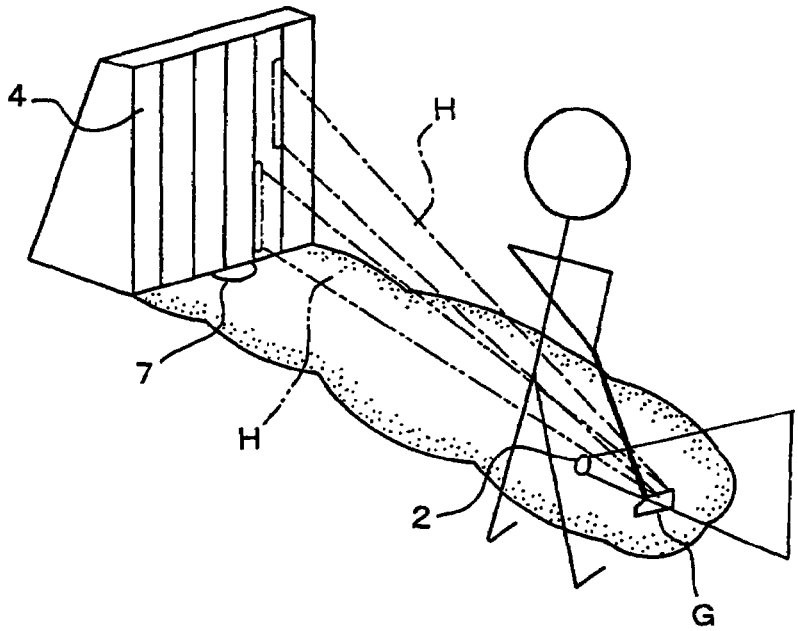
FIG. 40 is a view in a state that a customer is in a posture of address in front of a golf address deviation detecting apparatus according to a fourteenth embodiment.

FIG. 40 shows a fourteenth embodiment. The fourteenth embodiment has a feature that it includes a light irradiating unit 2 disposed below a club head K of a golf club G in a manner to irradiate light to a light reflecting section from the below of the club head K, and the reflected light is presented on the light receiving area 4. Also in the fourteenth embodiment, it is possible to clearly distinguish inaccuracy in loft angle, inaccuracy in lie angle, and inaccuracy in face orientation from one another, based on patterns of reflected light.

Figure 41:
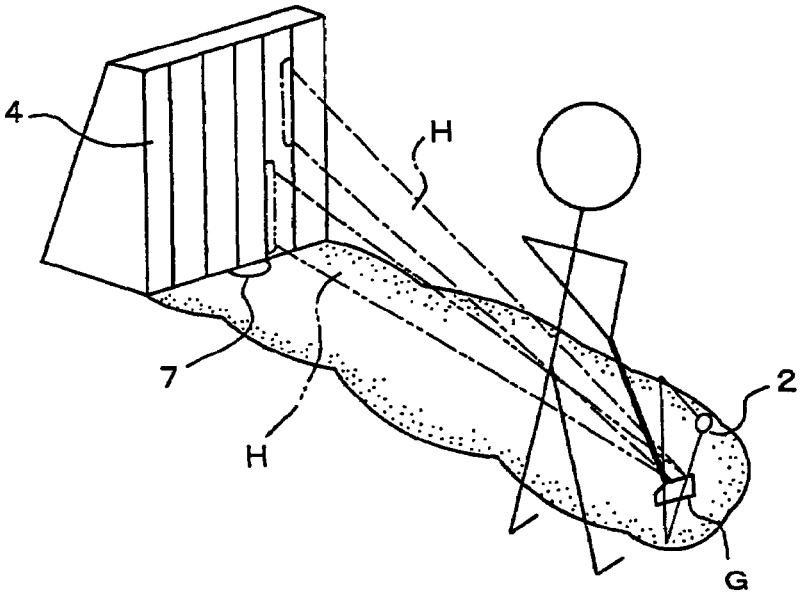
FIG. 41 is a view in a state that a customer is in a posture of address in front of a golf address deviation detecting apparatus according to a fifteenth embodiment.

FIG. 41 shows a fifteenth embodiment. The fifteenth embodiment has a feature that it includes a light irradiating unit 2 disposed sideward of a club head K of a golf club G in a manner to irradiate light to a light reflecting section from the sideward of the club head K, and the reflected light is presented on the light receiving area 4. Also in the fifteenth embodiment, it is possible to clearly distinguish inaccuracy in loft angle, inaccuracy in lie angle, and inaccuracy in face orientation from one another, based on patterns of reflected light presented on the light receiving area 4.

Figure 42:
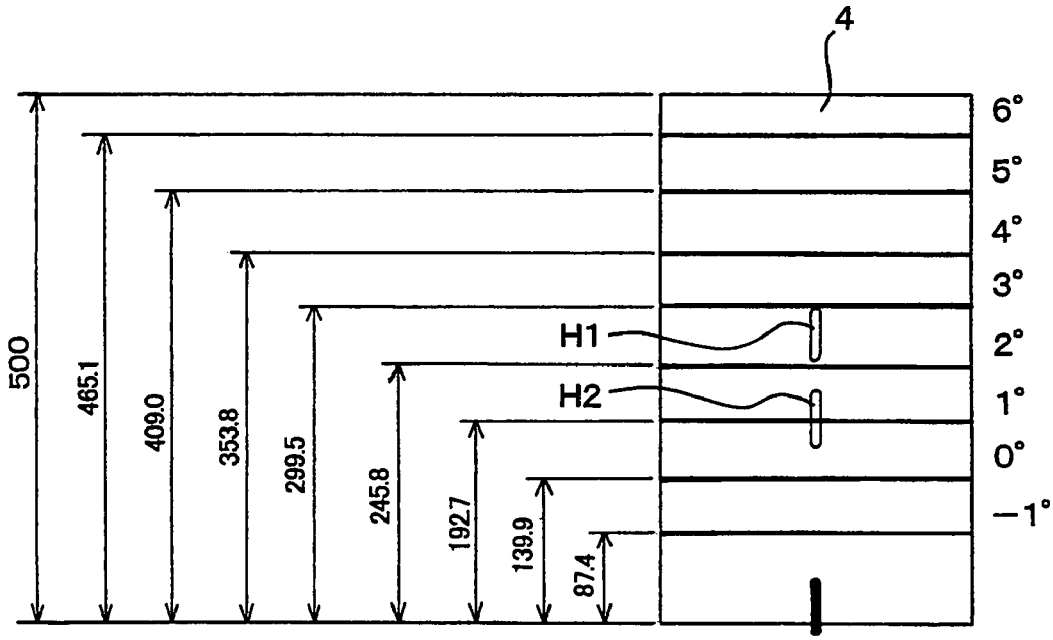
FIG. 42 is a front view of a light receiving area.
Figure 43:
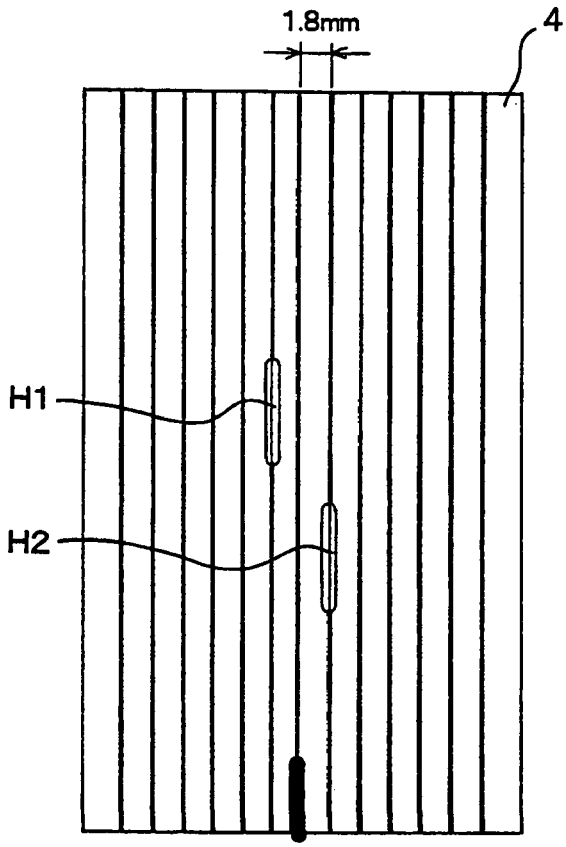
FIG. 43 is a front view of another light receiving area.
Figure 44:
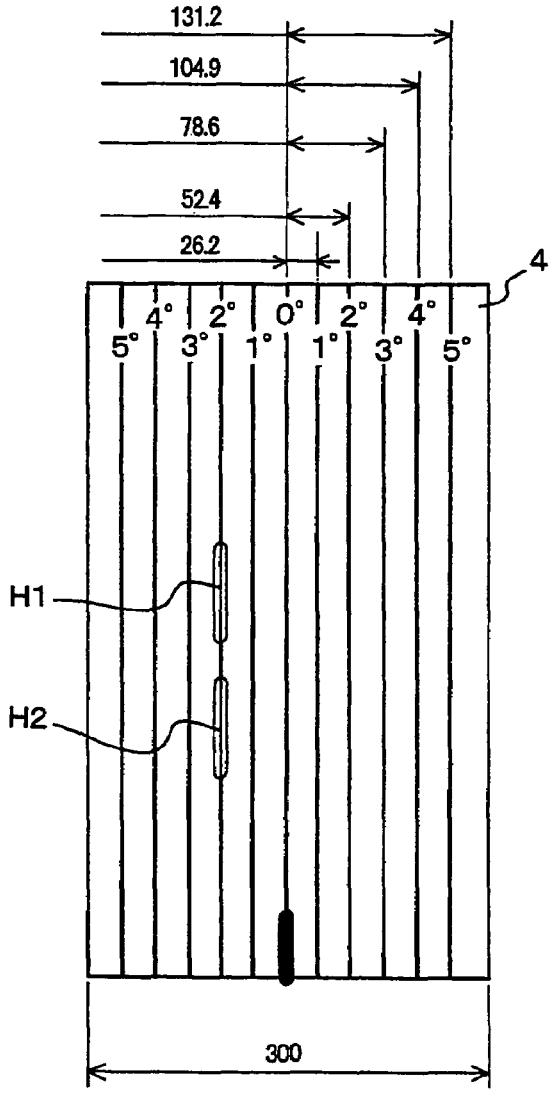
FIG. 44 is a front view of still another light receiving area.
Figure 45:
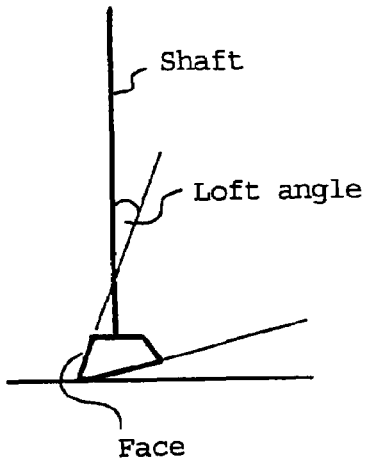
FIG. 45 is an explanatory view of a loft angle.
Figure 46:
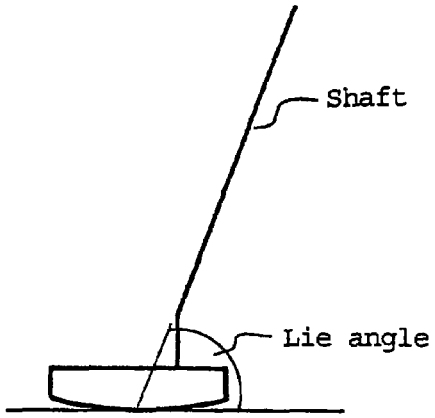
FIG. 46 is an explanatory view of a lie angle.
Figure 49:
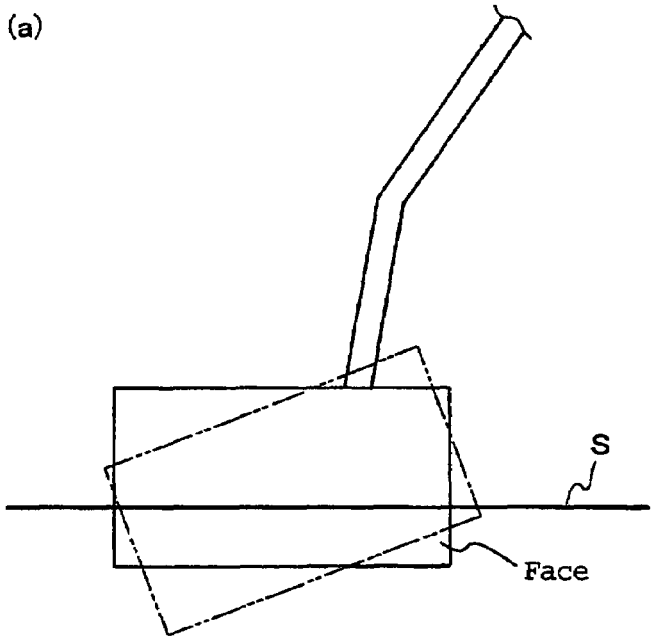
FIG. 49 is a view of a state that a face orientation is deviated from an accurate direction due to a deviation in lie angle.
Figure 49:
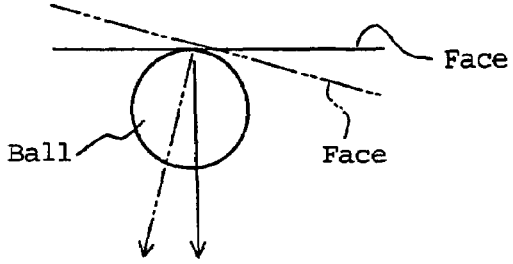
Figure 47:
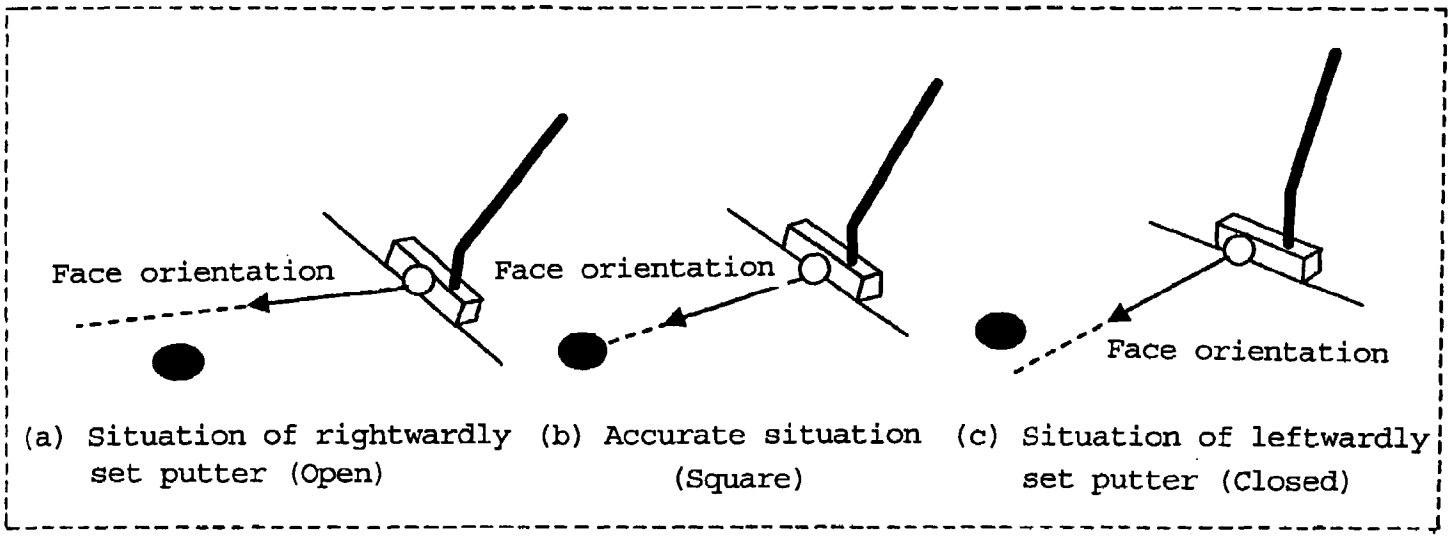
FIG. 47 is an explanatory view of a face orientation.
Figure 48:
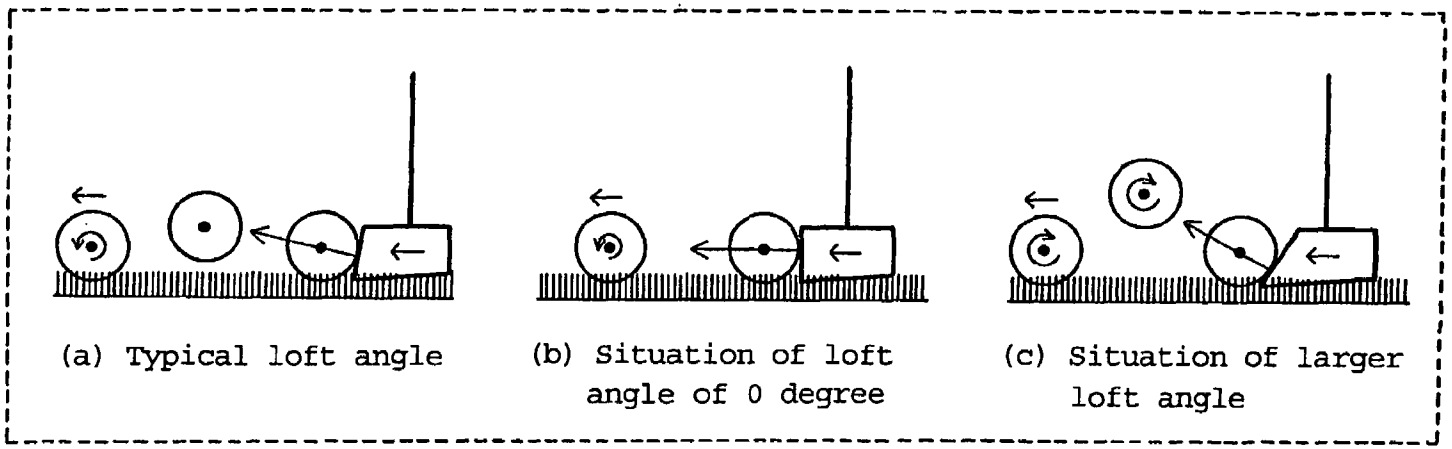
FIG. 48 is a view of a state that ball-hitting directions are changed depending on degrees of loft angle.
Figure 50:
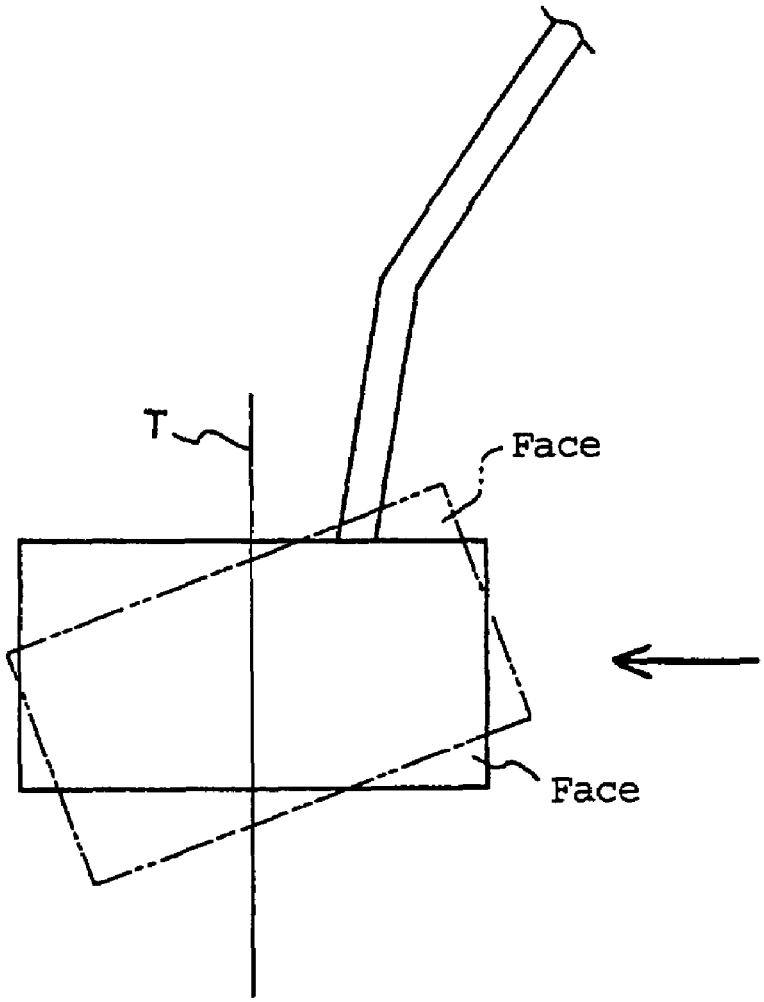
FIG. 50 is a view of a state that a loft angle is deviated from an accurate angle due to a deviation in lie angle.
Figure 50:
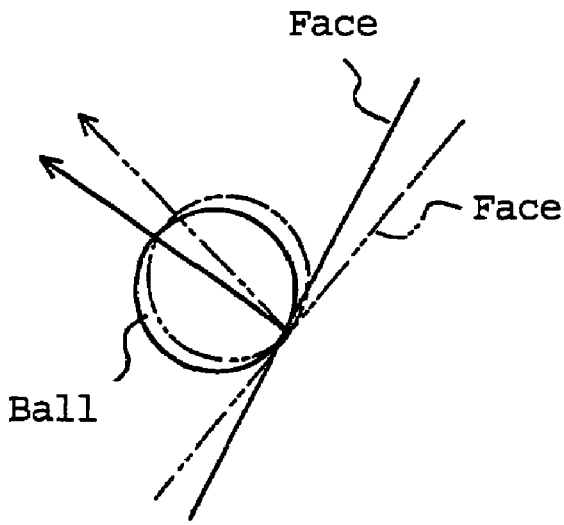
Figure 51:
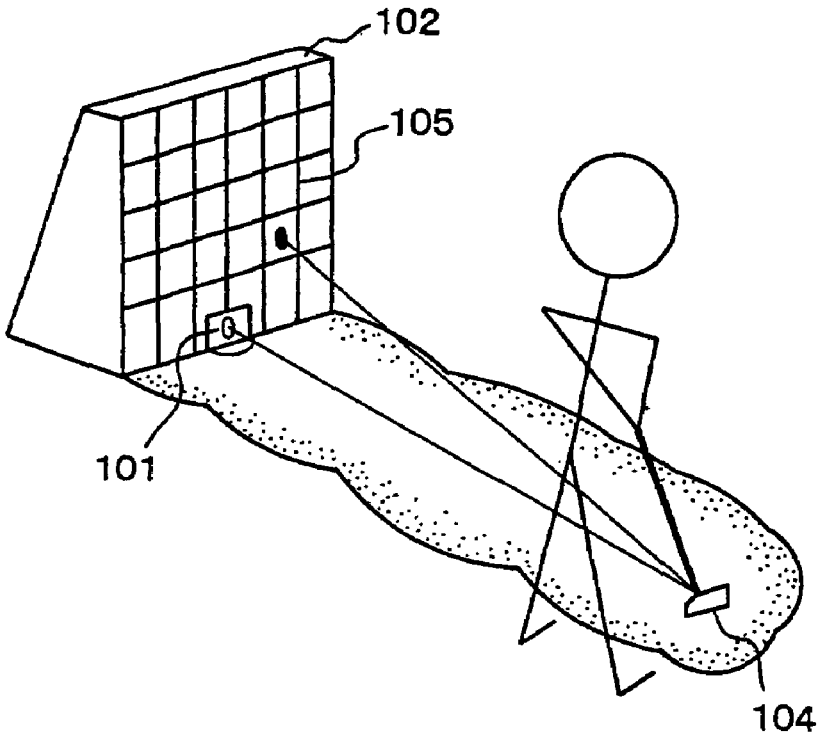
FIG. 51 is a schematic view of an apparatus according to the related art.
Figure 52:
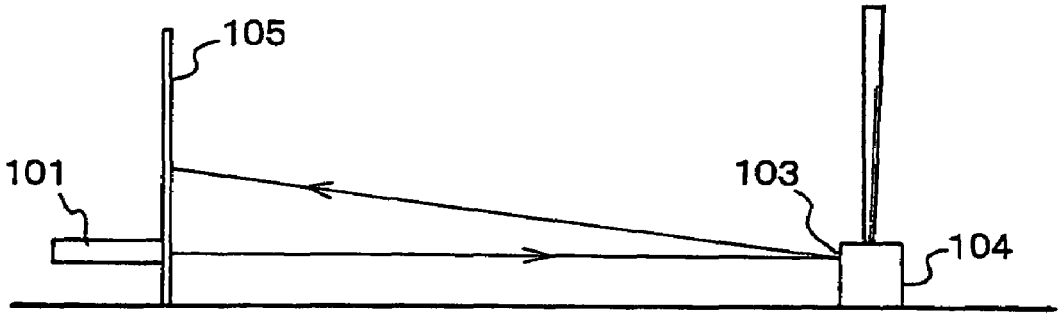
FIG. 52 is a schematic view of a positional relationship between a light irradiating unit, a light reflecting section, a light receiving area, and a golf club in the apparatus according to the related art.
Figure 53:
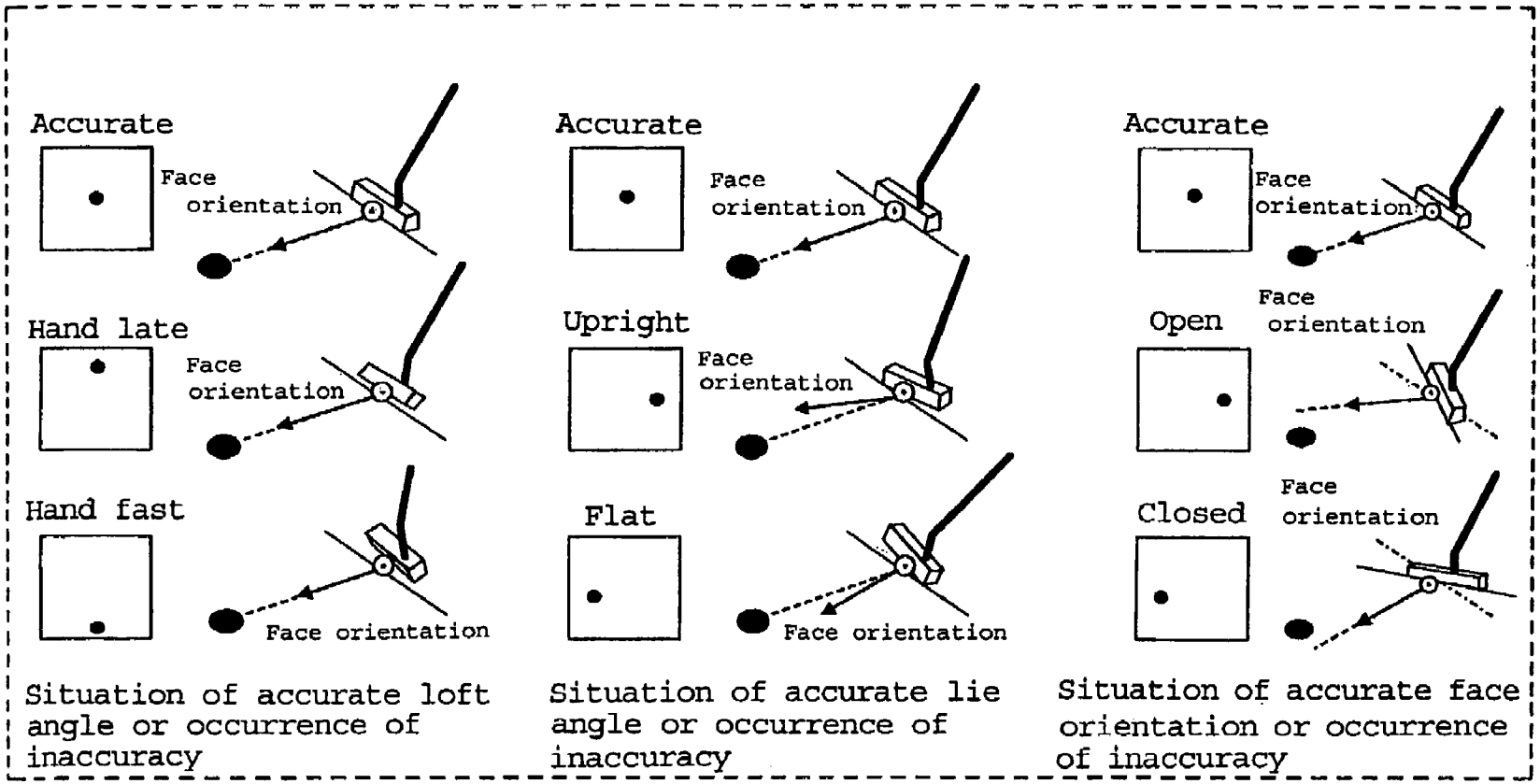
FIG. 53 is a schematic view of positions of reflected light presented on the light receiving area.

FIG. 42 through FIG. 44 show the above-mentioned means for numericalizing inaccuracies in loft angle, lie angle, and face orientation. Firstly, FIG. 42 shows means for numericalizing a loft angle. Namely, FIG. 42 is a front view of a light receiving area 4 in a state presenting reflected light-beams H1, H2 thereon. The light receiving area 4 is assumed to be located at a position separated from the face by 1.5 meters. The light receiving area 4 have angle marks drawn thereon correspondingly to distances from a lower edge of the light receiving area 4 itself. In the figure, "0 degree" means a loft angle of 0 degree. FIG. 42 shows a situation where an inaccuracy of 3 degrees has occurred in loft angle.

FIG. 43 shows means for numericalizing a lie angle. Namely, FIG. 43 is a front view of a light receiving area 4 in a state presenting reflected light-beams H1, H2 thereon. The light receiving area 4 is assumed to be located at a position separated from the face of the golf club by 1.5 meters. The light receiving area 4 have scale marks drawn thereon at intervals of 1.8 mm. It is possible to numericalize an inaccuracy in lie angle, by reading applicable scale marks for the reflected light-beams H1, H2 on the light receiving area 4.

FIG. 44 shows means for numericalizing inaccuracy in face orientation. Namely, FIG. 44 is a front view of a light receiving area 4 in a state presenting reflected light-beams H1, H2 thereon. The light receiving area 4 is assumed to be located at a position separated from the face of the golf club by 1.5 meters. The light receiving area 4 have angle marks drawn thereon correspondingly to dimensions deviated from 0 degree as a reference. FIG. 44 shows a situation where an inaccuracy of 2 degrees has occurred in face orientation.

In the above description, the embodiments have been explained where the present invention is applied to detect inaccuracies in loft angle, lie angle, and face orientation upon address of golf club. However, it is also possible to apply the present invention to another sporting good having a hitting surface. Namely, it is possible to attach a light reflecting section onto the hitting surface of the sporting good and to irradiate light onto the light reflecting section in a manner to project the light reflected by the light reflecting section onto a light receiving area, thereby detecting inclination angles of the hitting surface about the three axis directions based on spectrum patterns of reflected light-beams. Namely, since inclinations in loft angle, lie angle, and face orientation of a golf club correspond to inclinations of the hitting surface about the three axis directions, respectively, it is possible to detect inclination angles of the hitting surface of the other sporting good about the three axis directions in the same manner as the situations for detecting inaccuracies in loft angle, lie angle, and face orientation in the above-mentioned embodiments.

Although reflected light-beams have been configured to be projected onto the light receiving area in the above explanation, it is possible to project reflected light-beams onto a wall surface of a building or the like without providing a dedicated light receiving area.

What is claimed is:

1. A golf address deviation detecting apparatus for detecting inaccuracies in loft angle, lie angle, and face orientation upon address by a stationary golf club, the apparatus comprising:

multiple light reflecting sections attached to a pedestal;

said pedestal being detachably mounted on an existing striking face of the golf club;

said multiple light reflecting sections being attached to the pedestal so as to be concavely bent so as to form an angle therebetween ranging from one degree to five degrees and in a top to bottom direction with respect to the existing striking face of the golf club;

a light receiving area, said light receiving area comprising a light source and a light receiving grid; and said light source irradiating specific position focused light-beams onto the light reflecting sections, respectively;

said light source being a laser light source and said focused light-beam being a line laser:

wherein the light reflecting sections are arranged in positions where extensions of the planes of the light reflecting sections are intersected with each other; and wherein the apparatus detects inaccuracies in loft angle, lie angle, and face orientation and distinguishes them from one another upon a stationary address by the golf club based on differences among the position of the line laser, reflected by the light reflecting sections, on the light receiving grid of the light receiving area.

2. The golf address deviation detecting apparatus of claim 1, wherein the differences among patterns of the reflected light-beams are differences among positions of the reflected light-beams, differences among cross-sectional shapes of the reflected light-beams, differences among inclinations of cross-sectional shapes of the reflected light-beams, or differences among scales of cross-sectional shapes of the reflected light-beams, on the light receiving area.

3. A golf address deviation detecting apparatus for detecting inaccuracies in loft angle, lie angle, and face orientation upon address by a stationary golf club, the apparatus comprising:

a light reflecting section detachably mounted to a detachable pedestal on an existing striking face of the golf club;

said light reflecting section being shaped so as to be concavely bent so as to form an angle therebetween ranging from one degree to five degrees and with respect to an up and down direction of the existing striking face of the golf club; and light irradiating units configured to irradiate specific position focused line laser light-beams onto the light reflecting section; wherein the shape of the light reflecting section is formed so that the apparatus detects inaccuracies in loft angle, lie angle, and face orientation and distinguishing them from one another upon a stationary address of the golf club, based on differences among patterns of the line laser light-beams reflected by the light reflecting section onto a light receiving area.

4. The golf address deviation detecting apparatus of claim 3, wherein the differences among patterns of the reflected light-beams are differences among positions of the reflected light-beams on the light receiving area.

5. The golf address deviation detecting apparatus of claim 3, wherein the differences among patterns of the reflected light-beams are differences among positions of the reflected light-beams, differences among cross-sectional shapes of the reflected light-beams, differences among inclinations of cross-sectional shapes of the reflected light-beams, or differences among scales of cross-sectional shapes of the reflected light-beams, on the light receiving area.

6. The golf address deviation detecting apparatus of claim 1, further comprising the light receiving area configured to present thereon light-beams reflected by the light reflecting sections, respectively.

7. The golf address deviation detecting apparatus of claim 1, further comprising scale marks provided on the light receiving area, for numericalizing inaccuracies in loft angle, lie angle, and face orientation upon address, respectively.

8. A sporting form detecting apparatus for detecting inclination angles of a hitting surface possessed by a sporting good for hitting a ball upon playing by using the sporting good, the apparatus comprising:

multiple light reflecting sections detachably mounted to a detachable pedestal on the existing hitting surface;

said multiple light reflecting sections being shaped so as to be concavely bent so as to form an angle therebetween ranging from one degree to five degrees and with respect to an up and down direction of the existing hitting face of the sporting form detecting apparatus; and light irradiating units configured to irradiate specific position focused line laser light-beams onto the light reflecting sections, respectively;

wherein the light reflecting sections are arranged in positions where extensions of the planes of the light reflecting sections are intersected with each other; and wherein the apparatus detects inclination angles in three axis directions of the hitting surface upon playing by using the sporting good, based on differences among patterns of the line laser light-beams reflected by the light reflecting sections onto a light receiving area, respectively.

9. The sporting form detecting apparatus of claim 8, wherein the differences among patterns of the reflected light-beams are differences among positions of the reflected light-beams on the light receiving area.

10. The sporting form detecting apparatus of claim 8, wherein the differences among patterns of the reflected light-beams are differences among positions of the reflected light-beams, differences among cross-sectional shapes of the reflected light-beams, differences among inclinations of cross-sectional shapes of the reflected light-beams, or differences among scales of cross-sectional shapes of the reflected light-beams, on the light receiving area.

11. A sporting form detecting apparatus for detecting inclination angles of a hitting surface possessed by a sporting good for hitting a ball upon playing by using the sporting good, the apparatus comprising:

a light reflecting section detachably mounted to a detachable pedestal on the existing hitting surface;

said light reflecting section being shaped so as to be concavely bent so as to form an angle therebetween ranging from one degree to five degrees and with respect to an up and down direction of the existing hitting face of the sporting form detecting apparatus; and light irradiating units configured to irradiate specific position focused line laser light-beams onto the light reflecting section;

wherein the light reflecting section is formed so that the apparatus detects inclination angles in three axis directions of the hitting surface upon playing by using the sporting good, based on differences among patterns of the line laser light-beams reflected by the light reflecting section onto a light receiving area.

12. The sporting form detecting apparatus of claim 11, wherein the differences among patterns of the reflected light-beams are differences among positions of the reflected light-beams on the light receiving area.

13. The sporting form detecting apparatus of claim 11, wherein the differences among patterns of the reflected light-beams are differences among positions of the reflected light-beams, differences among cross-sectional shapes of the reflected light-beams, differences among inclinations of cross-sectional shapes of the reflected light-beams, or differences among scales of cross-sectional shapes of the reflected light-beams, on the light receiving area.

14. The sporting form detecting apparatus of claim 8, further comprising the light receiving area configured to present thereon light-beams reflected by the light reflecting sections, respectively.

15. The sporting form detecting apparatus of claim 8, further comprising scale marks provided on the light receiving area, for numericalizing inclination angles of the hitting surface upon hitting, respectively.

* * * * *